US007022092B2

(12) United States Patent
Shimizu et al.

(10) Patent No.: US 7,022,092 B2
(45) Date of Patent: Apr. 4, 2006

(54) FOUR MASSAGING HEAD TYPE MASSAGING MECHANISM AND MASSAGING APPARATUS INCORPORATING THE SAME

(75) Inventors: Nobuzo Shimizu, Higashi-Osaka (JP); Satoru Shiraishi, Higashi-Osaka (JP); Shu Lv, Higashi-Osaka (JP)

(73) Assignee: Daito Electric Machine Industry Company Limited, Osaka (JP)

( * ) Notice: Subject to any disclaimer, the term of this patent is extended or adjusted under 35 U.S.C. 154(b) by 90 days.

(21) Appl. No.: 10/700,550

(22) Filed: Nov. 5, 2003

(65) Prior Publication Data

US 2004/0171972 A1 Sep. 2, 2004

(30) Foreign Application Priority Data

Feb. 28, 2003 (JP) ..... 2003-054508

(51) Int. Cl.
*A61H 15/00* (2006.01)

(52) U.S. Cl. ..... 601/99; 601/100; 601/102; 601/116; 601/126

(58) Field of Classification Search ..... 601/86, 601/87, 90–91, 93–95, 98–99, 100–103, 601/112, 113, 115, 116, 126
See application file for complete search history.

(56) References Cited

U.S. PATENT DOCUMENTS

| | | | | |
|---|---|---|---|---|
| 5,052,376 | A * | 10/1991 | Yamasaki | 601/108 |
| 6,083,181 | A * | 7/2000 | Marcantoni | 601/99 |
| 6,213,962 | B1 * | 4/2001 | Shimizu | 601/90 |
| 6,224,563 | B1 * | 5/2001 | Nonoue et al. | 601/99 |
| 6,443,917 | B1 * | 9/2002 | Canto | 601/99 |
| 6,629,939 | B1 * | 10/2003 | Jikiba et al. | 601/99 |

FOREIGN PATENT DOCUMENTS

JP 2000-237257 A 9/2000

* cited by examiner

*Primary Examiner*—Quang D. Thanh
(74) *Attorney, Agent, or Firm*—Birch, Stewart, Kolasch & Birch, LLP

(57) ABSTRACT

A massaging mechanism includes a first rotary shaft supported in a right-and-left direction right and left swing arms relatively rotatably mounted on the first rotary shaft, massaging heads each secured to an upper and a lower end portion of each of the swing arms, a bracing member engaged with each of the swing arms to restrain the swing arm from rotating in connection with rotation of the first rotary shaft, a first operating mechanism for swinging the swing arms in opposite directions in the right-and-left direction to each other so that a right and left pair of massaging heads respectively secured to the upper end portions move toward each other while the massaging heads respectively secured to the lower end portions of the swing arms are moved away from each other in the right-and-left direction, and vice versa, by the rotation of the first rotary shaft.

6 Claims, 23 Drawing Sheets

FOUR MASSAGING HEAD TYPE MASSAGING MECHANISM AND MASSAGING APPARATUS INCORPORATING THE SAME

This Nonprovisional application claims priority under 35 U.S.C. §119(a) on Patent Application No(s). 2003-054508 filed in JAPAN on Feb. 28, 2003, the entire contents of which are hereby incorporated by reference.

BACKGROUND OF THE INVENTION

1. Field of the Invention

The present invention relates to a four massaging head type massaging mechanism for massaging a user's body with four massaging heads which are independent of each other, and massaging apparatus incorporating the massaging mechanism.

2. Description of the Related Art

Massaging apparatus in which a four massaging head type massaging mechanism for massaging a user's body with four independent massaging heads is installed in a backrest is known particularly in the technical field of chair type massaging apparatus. The massaging mechanism concerned has a rotary shaft supported in the right-and-left direction, a pair of right and left swing arms which are interlockingly linked to the rotary shaft so that one ends and the other ends of the swing arms corresponding in the right-and-left direction to each other are moved in the opposite directions in the right-and-left direction in conformity with the rotation of the rotary shaft, and a massaging head which is secured to each of one end portion and the other end portion of each swing arm (see Japanese Unexamined Patent Publication No. 2000-237257, for example).

A pair of right and left cam members having cam faces which are inclined in the opposite directions with respect to the rotary shaft are fixed to the rotary shaft. A radially outwardly projecting lever is secured to each cam member so as to be relatively rotatable with respect to the cam member, and a center portion of each swing arm is rotatably linked to the tip of the lever, so that each swing arm is swung in the right and left direction through the lever by the cam function of the cam member fixed to the rotary shaft.

Accordingly, the massaging heads on one end portion side of the swing arms (and the massaging heads on the other end portion side of the swing arms) are approached to and separated from each other to thereby carry out a massaging operation.

The above massaging mechanism further includes a rotary shaft for tapping operation disposed in parallel to the rotary shaft. The rotary shaft for tapping operation is provided with a crank member having a shaft portion eccentric with respect to an axis of the rotary shaft, and one end portion of a crank rod is pivotally secured to the crank member while the other end of the crank rod is pivotally secured to the lever.

When the rotary shaft for tapping operation is rotated, the crank rod is pressed and pulled through the crank member, whereby the lever is reciprocatingly moved about the rotary shaft. The reciprocating motions of the levers cause the massaging heads to carry out the tapping operation through the swing arms.

Since a back of a user's body is normally curved substantially in the S-shape from the lower side of the neck to the waist, the swing arm of the massaging mechanism described above is rotatably linked to the tip of the lever to rotate the swing arm in conformity with the S-shaped curve of the user's back, so that all the massaging heads can be substantially uniformly abutted to the back. Accordingly, the massaging operation using all the massaging heads can be efficiently performed.

However, this massaging apparatus has a disadvantage that the whole thickness of the massaging mechanism (the depth in the front-and-back direction) is increased by an amount corresponding to the lever because the massaging apparatus is provided with the lever projecting from the rotary shaft toward a front surface side of the backrest.

A large thickness of the massaging mechanism requires a broad space in the backrest for housing the massaging mechanism, and thus the thickness of the backrest must be increased to secure the space. Since this results in an increase in size and weight of the chair type massaging apparatus, an overall balance of the chair (the relative balance to the seat portion) is lost, and the appearance of the chair may be degraded.

Examples of conventional massaging apparatus further include a stationary massaging apparatus to be placed on a floor for use, and had-carriable massaging apparatus capable of being carried by hands in addition to the chair type massaging apparatus. In those examples, the large thickness of the massaging mechanism induces increase in size and weight of the overall massaging apparatus, resulting in an obstacle to portability.

In order to overcome the above disadvantage, the thickness of the massaging mechanism may be reduced by omitting the lever, i.e., securing the swing arm to the rotary shaft while directly coupling the crank rod to the swing arm. In this case, however, the rotation of the swing arm about the rotary shaft is restrained by the crank rod, thereby hindering all the massaging heads from uniformly contacting a user's back in conformity with the S-shaped curve of the back. Therefore, since some of the massaging heads cannot contact the user's body at all times or the kneading or tapping force is partially weakened, effective massaging operation cannot be performed.

SUMMARY OF THE INVENTION

In view of the foregoing situation, the present invention has an object to provide a massaging mechanism capable of performing an effective massaging operation having a reduced thickness, and massaging apparatus incorporating the massaging mechanism.

In order to attain the above object, the following technical means is provided.

That is, a massaging mechanism according to the invention comprises a first rotary shaft supported in a right-and-left direction, a pair of right and left swing arms relatively rotatably mounted on the first rotary shaft, massaging heads each secured to an upper end portion and a lower end portion of each of the swing arms, a bracing member engaged with each swing arm so as to restrain the swing arm from rotating in connection with rotation of the first rotary shaft, a first operating mechanism for swinging the swing arms in opposite directions in the right-and-left direction to each other so that a right and left pair of massaging heads respectively mounted on the upper end portions are moved toward each other while a pair of right and left the massaging heads respectively mounted on the lower end portions of the swing arms are moved away from each other in the right-and-left direction, and vice versa, by means of the rotation of the first rotary shaft, and a second operating mechanism linked to the bracing member for reciprocatingly rotating the swing arm about the axis of the first rotary shaft through the bracing member.

With this construction, the corresponding upper end portions and the lower end portions of the swing arms are respectively moved in the opposite directions in the right-and-left direction by the first operating mechanism, whereby massage such as kneading or the like can be performed by the massaging heads. Furthermore, the swing arm is reciprocatingly rotated about the axis of the first rotary shaft by the second operating mechanism, whereby massage such as tapping or the like can be performed by the massaging heads.

Furthermore, since the swing arm is secured to the first rotary shaft without using any lever in the conventional mechanism, the messaging mechanism of a compact size can be obtained by reducing the overall thickness of the massaging mechanism. At the same time, the number of parts and manufacturing costs can be reduced.

In the above case, if the second operating mechanism is kept fixed, the rotation of the swing arm about the first rotary shaft would be restrained, thereby hindering all the massaging heads from uniformly contacting a user's body. Therefore, there occurs such a disadvantage that some of the massaging heads cannot contact the user's body at all times and thus kneading or tapping is partially weakened, and thus the massaging operation cannot be effectively performed.

Therefore, the massaging mechanism according to the invention is provided with a guide support portion for supporting the second operating mechanism so that the second operating mechanism is movable following the rotation of the swing arm about the first rotary shaft.

Accordingly, when an external force is applied to the massaging heads secured to the upper end portions and the lower end portions of the swing arms, for example, when a part of the user's body such as a back is pressed against the massaging heads, the swing arm is rotated so that the respective massaging heads abut against the user's body substantially uniformly, and in conformity with this rotation of the swing arm, the second operating mechanism connected to the swing arm through the bracing member is moved through the guide support portion.

That is, the second operating mechanism is allowed to move irrespective of the provision of the swing arms to the first rotary shaft, whereby the swing arms are allowed to rotate when the user's body is pressed against the massaging heads. Accordingly, the respective massaging heads can be brought into substantially uniform contact with the user's body, and effective massage can be performed.

The second operating mechanism may comprise a second rotary shaft disposed in parallel to the first rotary shaft, a crank member that is provided on the second rotary shaft and has a shaft portion eccentric with respect to an axis of the second rotary shaft, and an interlocking member having one end portion joined to the shaft portion of the crank member and the other end portion joined to the bracing member, the interlocking member reciprocated in connection with a rotation of the second rotary shaft.

In this case, by the rotation of the second rotary shaft, the interlocking member is protruded/retracted (pressed/pulled) through the crank member, and the swing arm fitted to the bracing member joined to the interlocking member is reciprocatingly rotated about the first rotary shaft. This reciprocating motion repeatedly protrudes and retracts each massaging head to/from the user's body, thereby performing tapping massage.

In the invention, the first and second operating mechanisms are preferably overlapped with each other with respect to the thickness direction.

Furthermore, it is preferable that the first operating mechanism has a first driving member for rotary driving the first rotary shaft, and the second operating mechanism has a second driving member for rotary driving the second rotary shaft, the second driving member being disposed on a rear side of the first rotary shaft while the second rotary shaft and the first driving member are disposed on upper and lower sides of the first rotary shaft, respectively, in a sandwiching manner.

Accordingly, not only the thickness of the massaging mechanism, but also the longitudinal size thereof can be reduced, so that the whole size of the massaging mechanism can be further reduced.

Furthermore, it is preferable that the first operating mechanism has a first driving member for rotary driving the first rotary shaft, and the second operating mechanism has a second driving member for rotary driving the second rotary shaft, the first driving member and the second driving member being disposed between the right and left swing arms in the right-and-left direction.

Accordingly, the lateral width (the width in the right and left direction) of the massaging mechanism can be reduced, and the whole size of the massaging mechanism can be further reduced.

It is recommended that the bracing members, the crank members, and the interlocking members are provided in pair on right and left sides in conformity with the pair of right and left swing arms, and the second rotary shaft is provided with a half-rotation clutch mechanism for interlocking one of the right and left crank members with the other crank member so that the right and left crank members are mutually relatively rotatable within a substantially half-rotation range.

Where the second rotary shaft comprises a first shaft portion provided with one of right and left crank members and a second shaft portion provided with the other crank member, it is recommended to provide a half-rotation clutch mechanism between the first and the second shaft portions for interlockingly joining the shaft portions so that the shaft portions are relatively rotatable within the substantially half-rotation range.

In this case, when performing massage operations such as tapping or the like, movements of the massaging heads can be switched between a mode in which the two corresponding massaging heads in the right-and-left direction are alternately protruded toward the user's body and a mode in which the two corresponding massaging heads are simultaneously protruded by switching the direction of rotation of the second rotary shaft.

Furthermore, in the case where the tapping massage is carried out by alternatively protruding the two massaging heads corresponding in the right-and-left direction, and kneading massage is carried out immediately after the tapping massage, the hitting degree to the user's body is non-uniform between the right and left massaging heads because the projecting amounts of the right and left massaging heads to the user's body are different from each other.

Accordingly, in such a case, the subsequent kneading massage can be properly performed by rotating the second rotary shaft so that the projecting amount to the user's body is rendered equal between the two corresponding massaging heads in the right-and-left direction for kneading massage. Therefore, it is preferable that the second operating mechanism is controlled to rotate the second rotary shaft by at least a half-rotation so that the projecting amounts of the two corresponding massaging heads in the right-and-left direction to the user's body is set to be equal immediately before or substantially simultaneously with a starting of the massage operation by the first operating mechanism.

In this invention, it is recommended that the first operating mechanism comprises the first rotary shaft, a first driving member for rotary driving the first rotary shaft, and a pair of right and left cam members fixed to the first rotary shaft and having cam faces which are inclined in the opposite directions with respect to the rotary shaft and abutted to the swing arms, respectively.

In this case, the following swing motion is carried out. That is, when the first rotary shaft is rotated by actuating the first driving member, corresponding upper end portions of the right and left swing arms are approached to each other while corresponding lower portions of the swing arms get away from each other, and vice versa, by means of the cam faces inclined in the opposite directions. Accordingly, the massaging heads secured to the respective end portions of the swing arms are caused to perform kneading massage.

The four massaging head type massaging mechanism according to this invention comprises a first rotary shaft supported in a right-and-left direction, a pair of right and left swing arms relatively rotatably provided on the first rotary shaft, four massaging heads each secured to an upper end portion and a lower end portion of each of the swing arms, a first operating mechanism for swinging the swing arms in opposite directions in the right-and-left direction to each other so that a right and left pair of massaging heads respectively mounted on the upper end portions are moved toward each other while a pair of right and left the massaging heads respectively mounted on the lower end portions of the swing arms are moved away from each other in the right-and-left direction, and vice versa, by means of the rotation of the first rotary shaft, and a bracing member engaged with each swing arm so as to restrain the swing arm from rotating in connection with the rotation of the first rotary shaft and so as to be movable following the rotation of the swing arm about the first rotary shaft.

According to this invention, the corresponding upper end portions and the corresponding lower end portions of the swing arms are respectively moved in the opposite directions in the right-and-left direction by the first operating mechanism, whereby massage such as kneading or the like can be performed by the massaging heads. When an external force is applied to the massaging heads secured to the upper and lower end portions of the swing arms, for example, when a portion of the user's body such as the user's back is pressed against the massaging heads, the swing arms are rotated so that the respective massaging heads abut against the user's body substantially uniformly, and the bracing member is moved in connection with the rotation of the swing arms.

That is, in this invention, although the swing arms are provided on the first rotary shaft, since the bracing member is movable, the swing arms is allowed to rotate when the user's body is pressed against the massaging heads. Accordingly, the respective massaging heads can be brought into substantially uniform contact with the user's body and the effective massage can be performed.

Further, since the swing arms is provided on the first rotary shaft without any lever, the overall thickness of the massaging mechanism can be reduced, thereby reducing a whole size of the massaging mechanism. At the same time, number of parts and manufacturing costs can be also reduced.

For smoothly moving the bracing member engaged with the swing arm, it is preferable to provide a second guide support portion for movably supporting the bracing member. The second guide support portion may consist of a joint link for rotatably connecting the interlocking member and the bracing member, a slider provided on the joint link, and a guide rail for slidably supporting the slider.

The four massaging head type massaging mechanism as described above may be installed in various types of massaging apparatus such as a relatively compact-sized stationary massaging apparatus or hand-carriable massaging apparatus, or a relatively large-sized leaner type massaging apparatus or chair type massaging apparatus.

In the leaner type massaging apparatus and the chair type massaging apparatus, since the apparatus is required to perform massage on the back of the user's body in a broad range in the up-and-down direction, it is preferable to provide moving means for moving the massaging mechanism itself in the up-and-down direction.

Other objects, features and effects of the invention will be sufficiently understood through the following description.

DETAILED DESCRIPTION OF THE PREFERRED EMBODIMENTS

Preferred embodiments according to the invention will be described hereunder with reference to the accompanying drawings.

FIGS. 1 to 11 show a first embodiment of the invention.

Figure 1:
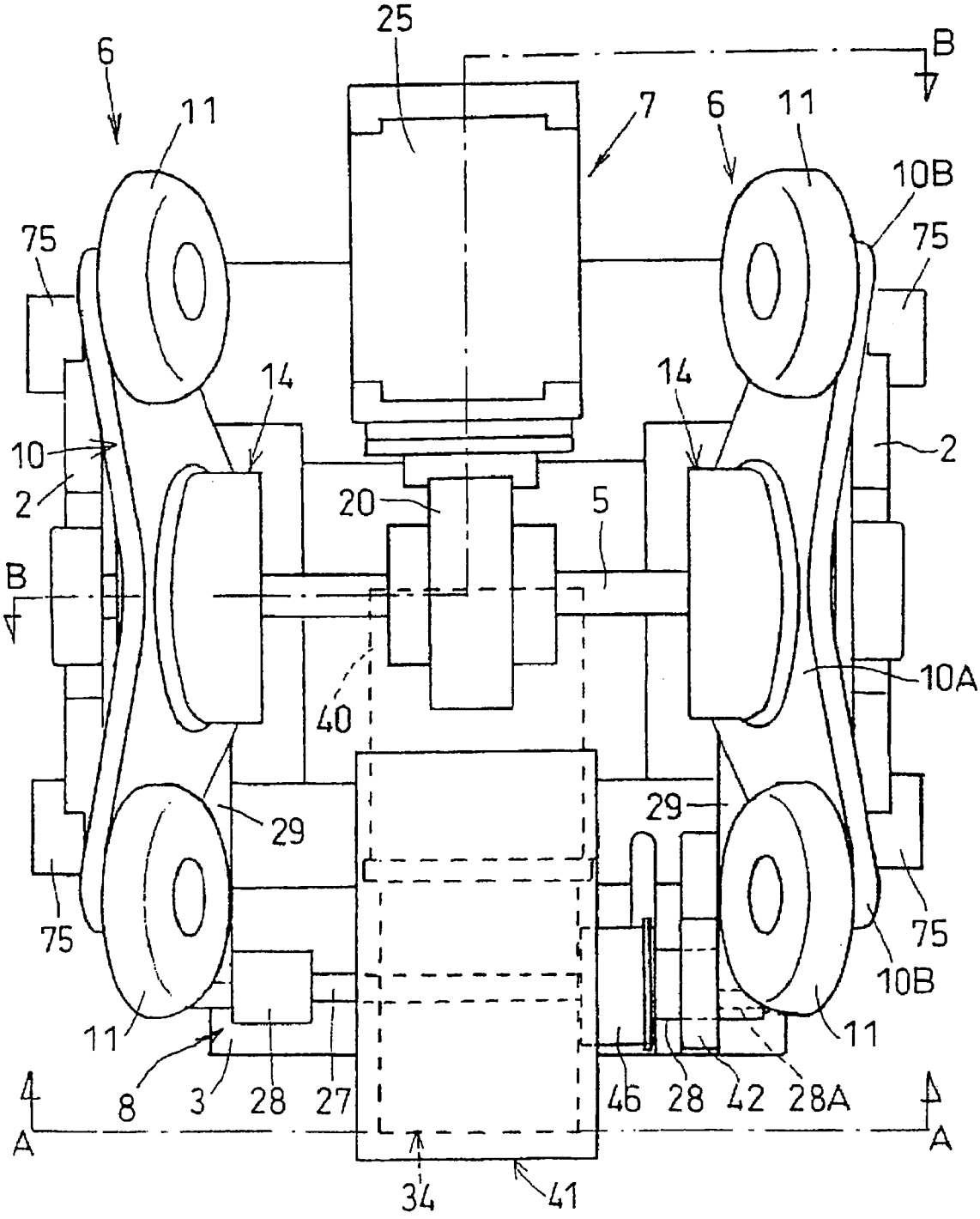
FIG. 1 is a front view showing a four massaging head type massaging mechanism according to a first embodiment of the invention.
Figure 2:
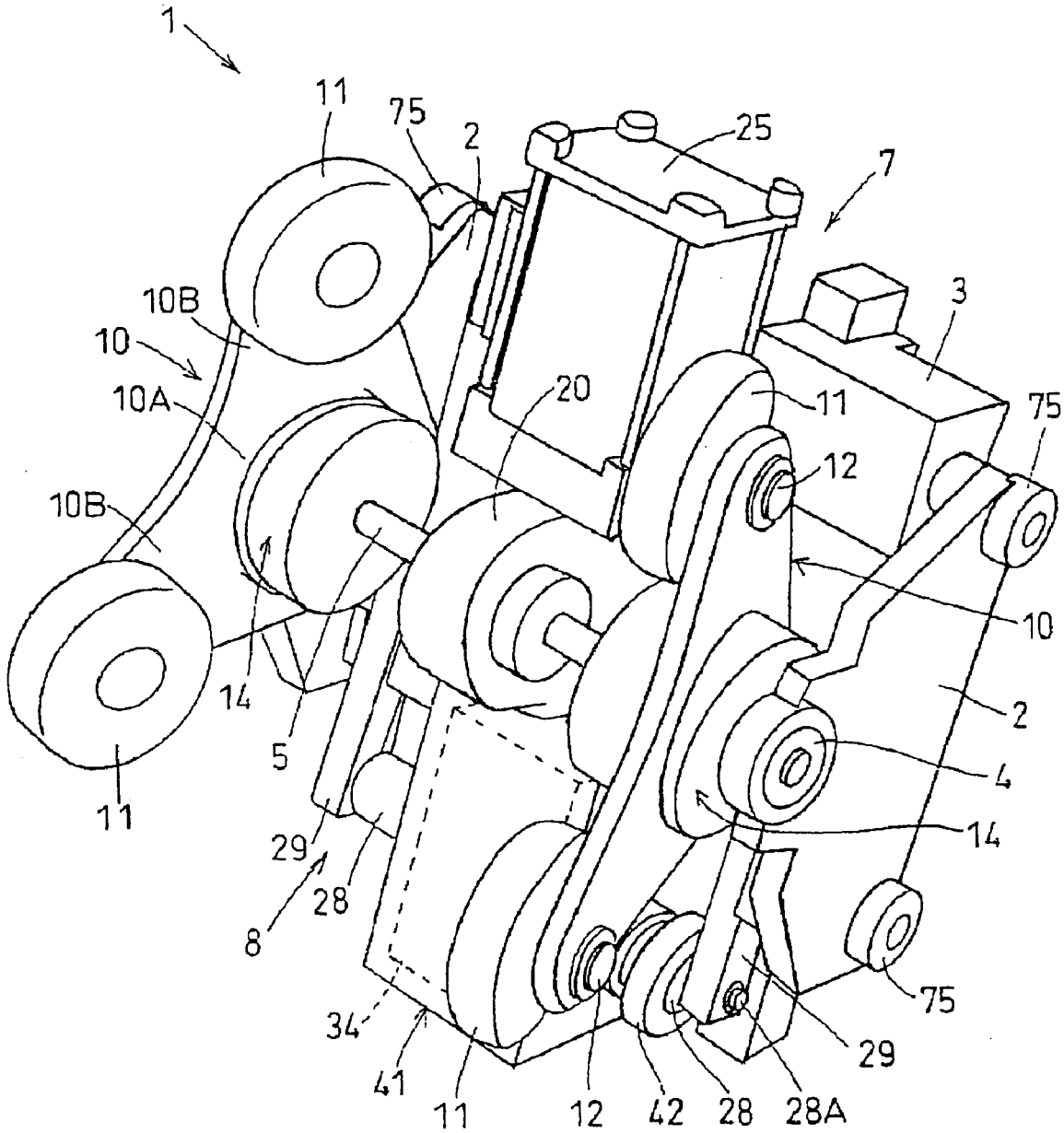
FIG. 2 is a perspective view showing the massaging mechanism of FIG. 1.

As shown in FIGS. 1 and 2, a massaging mechanism 1 according to this embodiment of the invention comprises a support frame 3 having right and left support brackets 2 disposed on right and left end portions thereof so as to be spaced from each other at a predetermined interval, a first rotary shaft 5 rotatably supported in the right-and-left direction at opposite end portions thereof through bearings 4,4 by the brackets 2 of the support frame 3, a four massaging head type massaging member 6 disposed on the first rotary shaft 5, a first operating mechanism 7 for causing the massaging member 6 to perform kneading massage and a second operating mechanism 8 for causing the massaging member 6 to perform tapping massage.

In the following description of the massaging mechanism 1, the right-and-left direction, the up-and-down direction and the sheet penetrating direction in FIG. 1 correspond to the right-and-left direction, the up-and-down direction and the front-and-rear direction (or the thickness direction) of the massaging mechanism 1, respectively.

The massaging member 6 includes a pair of right and left swing arms 10, and four massaging heads 11 each secured to one end portion and the other end portion (upper end portion and lower end portion) of each swing arm 10. Each swing arm 10 is formed of a substantially bifurcated resin plate material having an intermediate portion 10A through which the first rotary shaft 5 relatively rotatably penetrates, and a pair of arm portions 10B integrally obliquely projecting from the intermediate portion 10A so as to be away from the support frame 3 side.

The material of the swing arm 10 is not limited to the resin plate, but it may be formed of a metal plate material or the like. The swing arm 10 may be formed by covering a part or the whole of a surface of a metal plate material with a resin plate material.

Each of the massaging head 11 is formed in a circular shape, the center portion of which is rotatably secured to each end portion of each swing arm 10 through a mounting pin 12 extending in the right-and-left direction. The respective massaging heads 11 are disposed independently of one another and spaced from each other in the up-and-down direction and in the right-and-left direction so that each of the massaging heads 11 individually abuts against a user's body.

Figure 4:
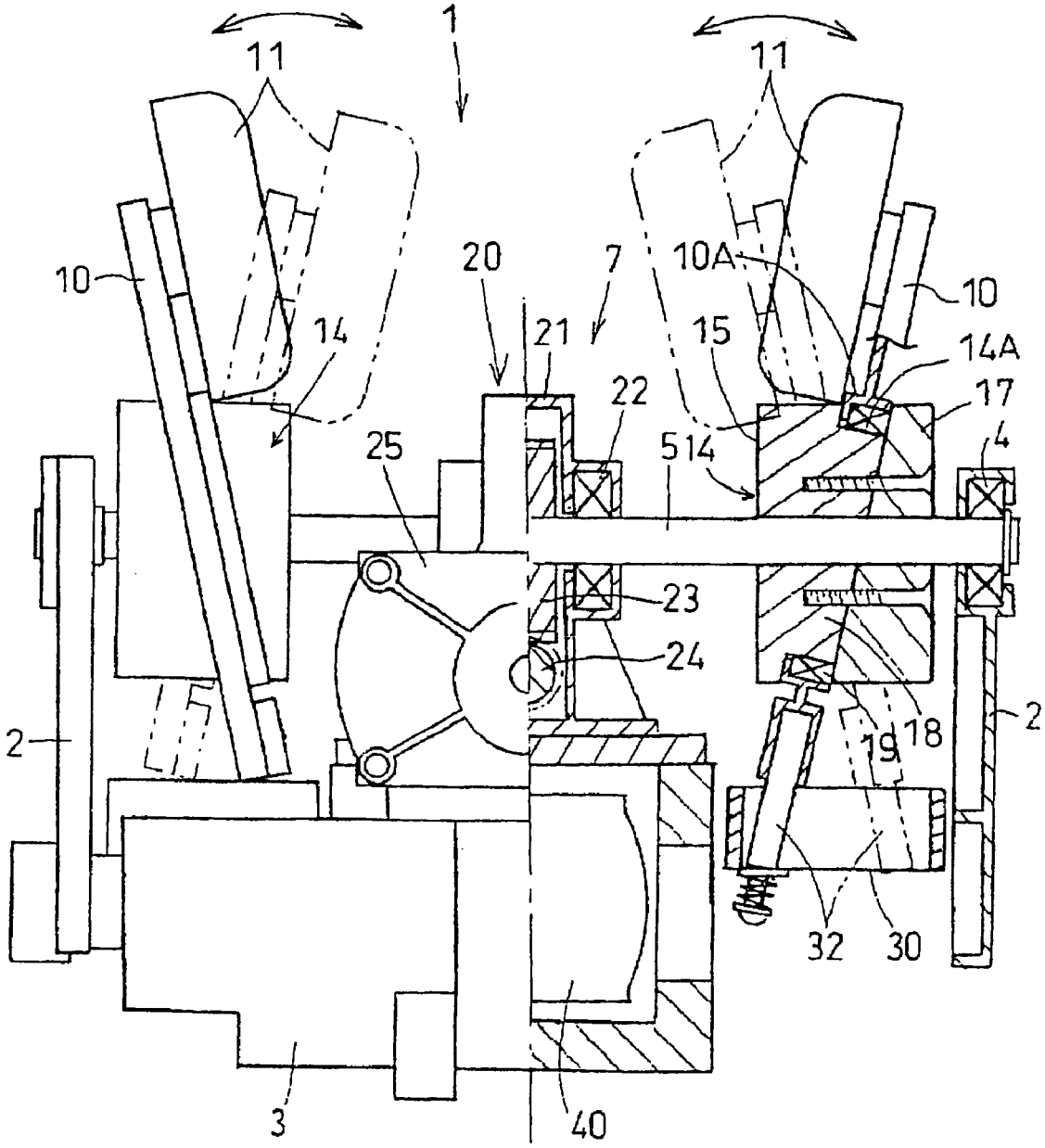
FIG. 4 is a diagram showing the massaging mechanism of FIG. 1 which is viewed from the direction of an arrow B—B.

A pair of right and left cam members 14 are fixed on intermediate positions of the first rotary shaft 5 in the axial direction thereof, and each of the cam members 14 has a cam face 14A inclined with respect to the rotary shaft 5. As shown in FIG. 4, the cam member 14 comprises a first boss portion 15 fixed to the first rotary shaft 5 through locking means such as a key or the like so that the first boss portion 15 is not rotatable relatively to the first rotary shaft 5 (rotatable along with the first rotary shaft 5), and a second boss portion 17 linked to the first boss portion 15 through a joint piece such as a screw. A slant cylindrical portion 18 which is inclined with respect to an axis of the first rotary shaft 5 is integrally formed at a center portion of the first boss portion 15, and the cam face 14A is defined by an outer peripheral surface of the slant cylindrical portion 18.

The respective cam faces 14A of the right and left cam members 14 are disposed to be inclined in the opposite directions.

The slant cylindrical portion 18 may be formed integrally with the second boss portion 17, or it may be separately formed as an independent member from the first and second boss portions 15, 17 and linked to them by a joint piece.

A peripheral edge portion of an engaging hole formed in the intermediate portion 10A of the swing arm 10 is relatively rotatably engaged with the cam face 14A through a bearing 19. However, where a friction resistance between the peripheral edge portion of the engaging hole and the cam face 14A is small to the extent that they are relatively smoothly slid, the bearing 19 may be omitted.

A reduction gear 20 is disposed at a substantially center portion so as to forwardly extend from the support frame 3, and the first rotary shaft 5 penetrates at an intermediate position thereof in the axial direction through the reduction gear 20. The reduction gear 20 includes a gear case 21, a bearing 22 for rotatably supporting the first rotary shaft 5 in the gear case 21, and a gear mechanism having a worm wheel 23 fixed to the first rotary shaft 5 and a worm 24 to be engaged with the worm wheel 23. An output shaft of a first driving member 25 comprising a forward/reverse rotating electric motor secured to an upper surface of the gear case 21 is connected to the worm 24.

Accordingly, an actuation of the first driving member 25 rotates the first rotary shaft 5 through the worm 24 and the worm wheel 23.

Furthermore, when the first rotary shaft 5 is rotated, a pair of right and left swing arms 10 are swung along the cam faces 14A of the cam members 14 which integrally rotate with the first rotary shaft 5, whereby each pair of massaging heads 11 corresponding in the right and left direction secured to each swing arm 10 are moved in the opposite directions to each other.

Figure 8A:
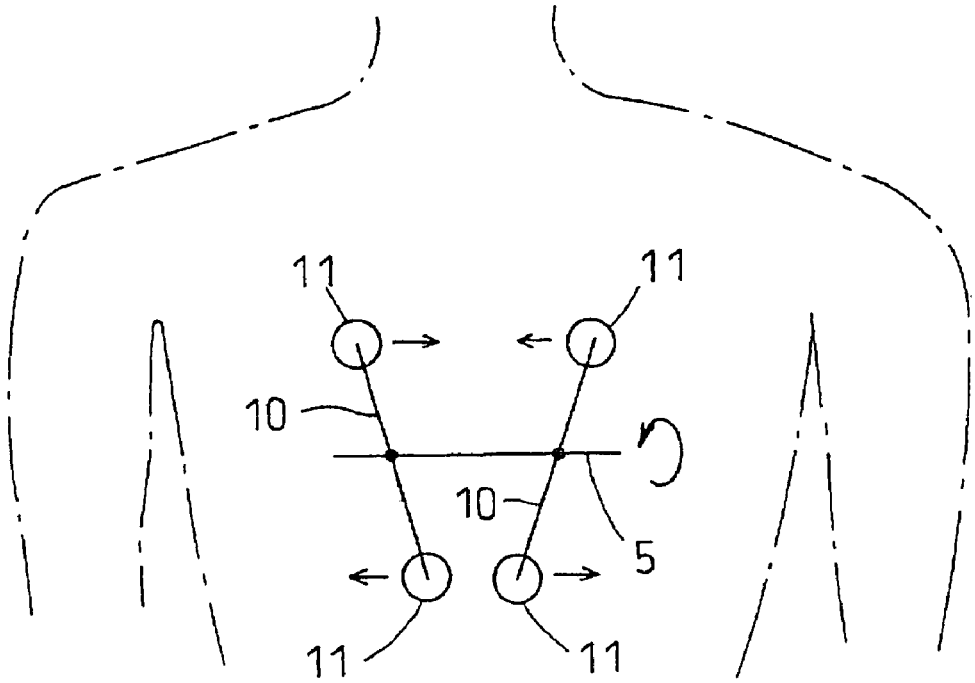
FIGS. 8A and 8B are operation diagrams showing a kneading massage motion.
Figure 8B:
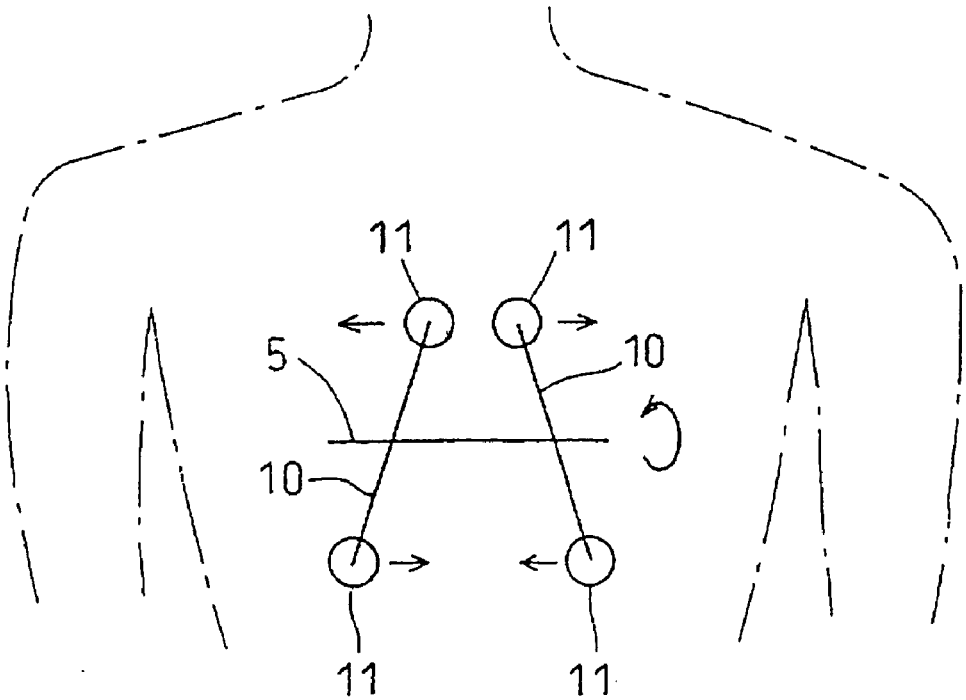

Since the cam faces 14A of the right and left cam members 14 are inclined in the opposite directions, the following operation as described in FIG. 8 is repeated: when the massaging heads 11 secured to the upper end portions of the right and left swing arms 10 approach to each other, the massaging heads 11 secured to the lower end portions thereof get away from each other. Conversely, when the massaging heads 11 secured to the upper end portions get away from each other, the massaging heads 11 secured to the lower end portions approach to each other.

Accordingly, kneading massage is performed by pinching the user's body with the massaging heads 11 corresponding in the right and left direction.

Here, the first driving member 25, the reduction gear 20, the first rotary shaft 5, the cam member 14, etc. constitute a first operating mechanism 7 for causing the massage member 6 to perform kneading massage.

A second rotary shaft 27 is disposed in the right-and-left direction in parallel to the first rotary shaft 5 on one end portion side (lower end portion) of the support frame 3, that is, on a side opposite to the first driving member 25 with respect to the first rotary shaft 5. A cylindrical crank member 28 is integrally formed at each of both the end portions of the second rotary shaft 27.

Figure 7:
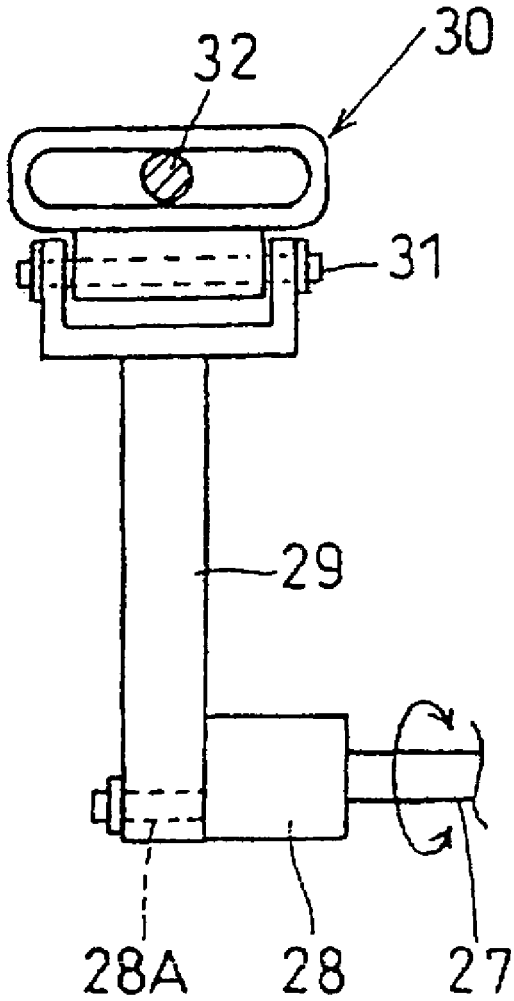
FIG. 7 is a front view showing the part of the second operating mechanism.

Shaft portions (crank portion) 28A each having an axis eccentric with respect to the axis of the second rotary shaft 27 are outwardly projectingly formed on a right end face of the right crank member 28 and on a left end face of the right crank member 28, and a lower end portion of an interlocking member 29 having a square-bar shape is pivotally joined to the shaft portion 28A, while an upper end portion of the interlocking member 29 is formed to be bifurcated in the right and left direction as shown in FIG. 7, and a bracing member 30 is pivotally mounted between the bifurcated portions through a joint pin 31.

Figure 5:
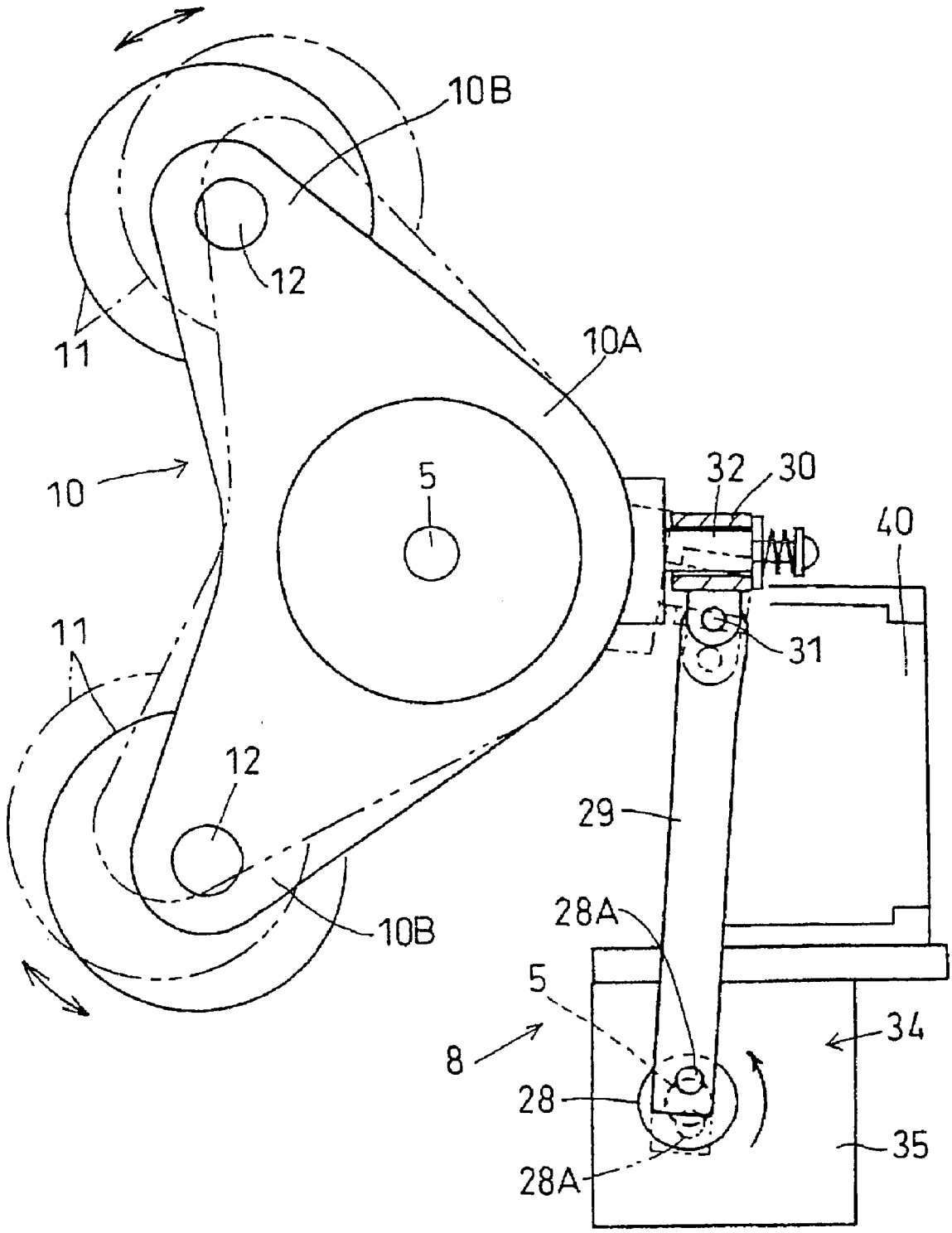
FIG. 5 is a side view showing a second operating mechanism.

The bracing member 30 has a cylindrical shape having a circular cross section elongated in the right and left direction. As shown in FIGS. 4 and 5, an engagement member 32 comprising a pin rearwardly projecting from the intermediate portion 10A of the swing arm 10 is inserted in the bracing member 30 so as to be engaged therewith.

With this construction, the swing arm 10 is restrained from rotating following the rotation of the first rotary shaft 5, and as shown in FIG. 4, the right and left movement of the engagement member 32 in connection with the right and left swinging motion of the swing arm 10 by the first operating mechanism 7 is permitted within the range corresponding to the width of the bracing member 30 in the right and left direction.

The bracing member 30 may be formed in a rod-shape extending along the right and left direction, and the engagement member 32 may be formed in a bifurcated shape so as to be engaged with the rod-shaped bracing member 30. Alternatively, the massaging mechanism may have a single bracing member 30, a single interlocking member 29, and a single crank member 28, wherein both of the swing arms 10 are engaged with the single bracing member 30.

Figure 10:
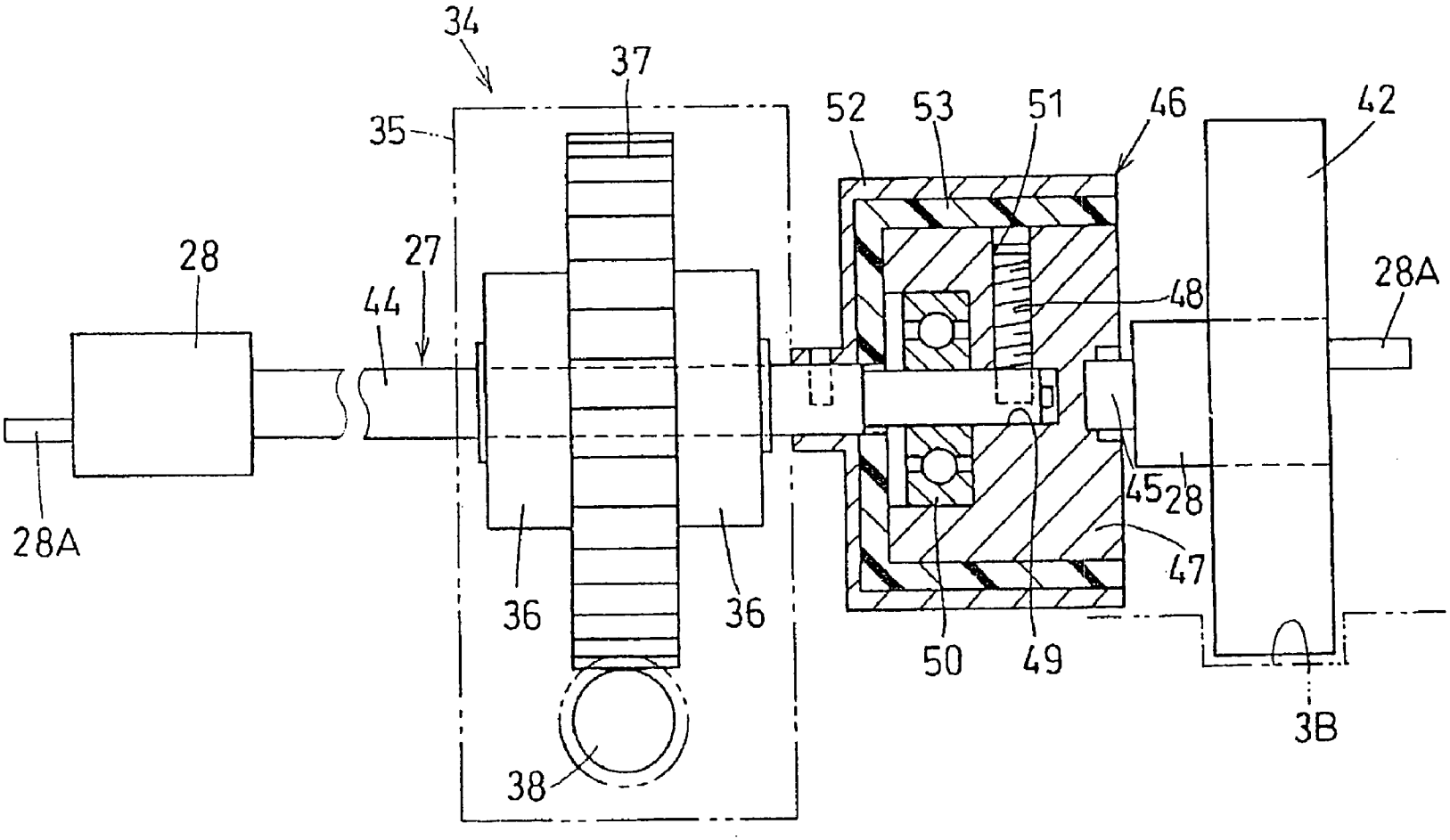
FIG. 10 is a cross-sectional view showing a half-rotation clutch mechanism.

The second rotary shaft 27 penetrates at an intermediate position in the axial direction thereof through the reduction gear 34 in the right and left direction, and the reduction gear 34 has a gear case 35, a bearing 36 for rotatably supporting the second rotary shaft 27 in the gear case 35, and a gear mechanism comprising a worm wheel 37 fixed to the second rotary shaft 27 and a worm 38 mated with the worm wheel 37 as shown in FIG. 10.

Figure 6:
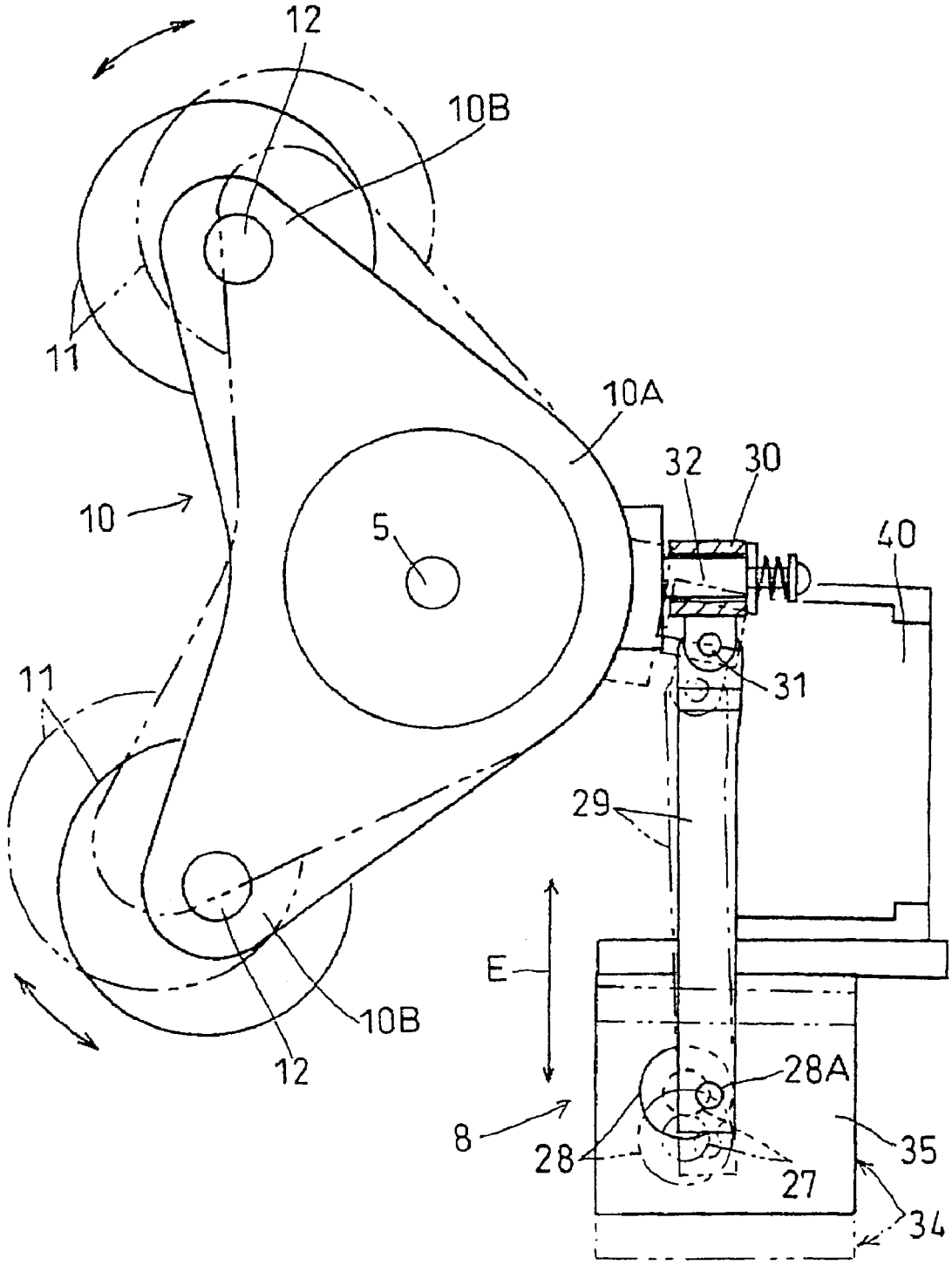
FIG. 6 is a side view showing the second operating mechanism.

As shown in FIGS. 1, 5, 6, a second driving member 40 comprising a forward/reverse electric motor is secured to the upper surface of the gear case 35, and an output shaft of the second driving member 40 is connected to the worm 38.

Accordingly, an actuation of the second driving member 40 causes the second rotary shaft 27 to rotate through the worm 38 and the worm wheel 37.

When the second rotary shaft 27 is rotated, the crank portion 28A is rotated about the axis of the crank member 28, and the interlocking member 29 linked to the shaft portion 28A is pressed and pulled (protruded and retracted) in the longitudinal direction thereof, whereby the swing arm 10 is reciprocatingly rotated (reciprocative turning motion) about the first rotary shaft 5 via the bracing member 30, as shown in FIG. 5.

At this time, the respective massaging heads 11 disposed on the one and the other end portions of the swing arm 10 are alternately protruded to and retracted from the user's body side (front side) to perform tapping massage on the user's body.

Here, the second driving member 40, the reduction gear 34, the second rotary shaft 27, the interlocking member 29, the crank member 28, etc. constitute the second operating mechanism 8 for causing the massage member 6 to perform massage operations such as tapping.

When the second rotary shaft 27 is rotated at a relatively high speed by the second driving member 40, since the user's body cannot follow the protruding/retracting motions of the massaging heads 11 and thus it does not resonate, the tapping massage as described above is performed. However, when the second rotary shaft 27 is rotated at a low speed to the extent that the user's body can follow the protruding/retracting motions of the massaging heads 11, a press massage (acupressure massage) by locally pressing user's body with each massaging head 11 may be performed.

Accordingly, the second operating mechanism 8 may be configured to adjust the rotary speed of the second driving member 40 so as to switchably perform tapping massage and press massage is selectively carried out or perform any one of the tapping massage and the press massage.

The adjustment of the rotary speed of the second rotary shaft 27 may be carried out by electrically varying the speed of the second driving member 40 with a control circuit or may be mechanically carried out by changing a gear combination or the like.

The second operating mechanism 8 is supported by a guide support portion 41 so as to be movable in the up-and-down direction orthogonal to the first rotary shaft 5 (in the longitudinal direction of the interlocking member 29).

Figure 3:
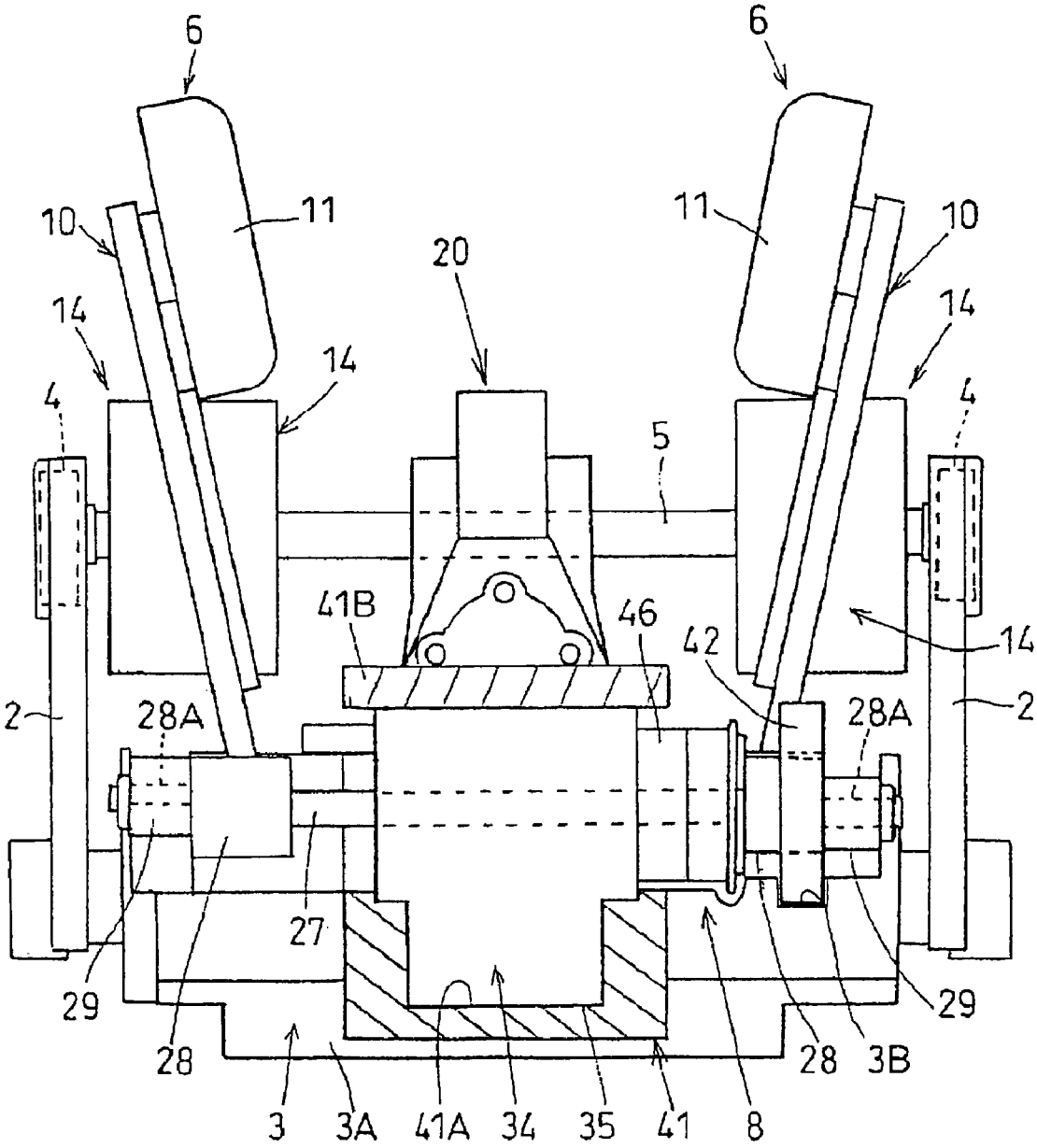
FIG. 3 is a diagram showing the massaging mechanism of FIG. 1 which is viewed from the direction of an arrow A—A.

As shown in FIG. 3, the guide support portion 41 is formed on a back plate 3A (base plate) of the support frame 3, and has a guide groove 41A in which a back portion of the gear case 35 is slidably engaged, and a press member 41B for pressing the front face of the gear case 35. The gear case 35 is interposed between the press member 41B and the guide groove 41A, so that the gear case 35 is movable along the guide groove 41A under a condition in which some degree of resistance is applied.

Accordingly, the guide groove 41A and the press member 41B constitute a guide rail, and the gear case 35 itself constitutes a slider to be slidably engaged with the guide rail.

Furthermore, a guide member 42 comprising a ball bearing is provided on an outer peripheral surface of one of the right and left crank members 28 (right side in this embodiment), and the guide member 42 is fitted in a guide groove 3B formed on the back plate 3A of the support frame 3 and guided therealong.

As described above, since the second operating mechanism 8 is movably supported, when an external force is applied to the massaging heads 11, for example, when the user's body is pressed against the massaging heads 11, the swing arms 10 are rotated about the first rotary shaft 5 in accordance with the curve of the user's (for example, the S-shaped curve of the user's back) so that the respective massaging heads 11 can be substantially uniformly contact the user's body, irrespective of which of the first or second operating mechanisms 7, 8 performs massage operations.

That is, as shown in FIG. 6, the swing arm 10 is restrained from being turned (dragged) about the first rotary shaft 5 by the bracing member 30. However, since the second operating mechanism 8 linked to the bracing member 30 is movably supported by the guide support portion 41, when the user's body is pressed against the massaging heads 11, the second operating mechanism 8 and the bracing member 30 are moved in the up-and-down direction indicated by an arrow E, so that the swing arm 10 is allowed to be turned.

Accordingly, the swing arms 10 according to the invention are capable of turning in accordance with the curve of the user's body although the swing arms 10 are secured to the first rotary shaft 5 and the second operating mechanism 8 allows the massage such as tapping. Therefore, it is unnecessary to secure the swing arms 10 to the first rotary shaft 5 through the levers as in the case of the prior art, whereby the overall thickness (front-and-back width) of the massaging mechanism 1 can be reduced, and the massaging mechanism 1 designed in a compact size can e obtained.

All the first driving member 25, the second driving member 40, the gear cases 21, 35 are disposed between the right and left massaging members 6, and thus the overall right-and-left width (lateral width) of the massaging mechanism 1 can be reduced.

Furthermore, the second driving member 40 of the second operating mechanism 8 is disposed on a rear side of the first rotary shaft 5 of the first operating mechanism 7, so that a lower portion of the first operating mechanism 7 and an upper portion of the second operating mechanism 8 are disposed to be overlapped with each other in the front-and-rear direction. Therefore, the height of the massaging mechanism 1 can be reduced.

The arrangement of the first driving member 25, the second driving member 40 and the reduction gears 20, 34 is not limited to the arrangement described above, but they may be disposed at the right and left outer sides of the massaging members 6 so as to be connected to the shaft end portions of the first and second rotary shafts 5, 27, or the first driving member 25 and the second driving member 40 may be disposed on lower sides of the reduction gears 20, 34, respectively. Alternatively, the positions of the first and second operating mechanisms 7, 8 may be reversed in the up-and-down direction, that is, the second operating mechanism 8 may be disposed on the upper side of the first operating mechanism 7.

As shown in FIG. 10, the second rotary shaft 27 has a first shaft portion 44 to which one of the right and left crank members 28 (left crank member in this embodiment) is provided, and a second shaft portion 45 to which the other crank member 28 (right crank member in this embodiment) of the right and left crank members 28 is provided. The shaft portions 44, 45 are disposed coaxially, and interlockingly linked to each other through a half-rotation clutch mechanism 46.

The first shaft portion 44 is rotatably supported by the bearing 36 in the gear case 35, and a driving force from the second driving member 40 is directly transmitted to the first shaft portion 44. The second shaft portion 45 is supported by the guide groove 3B through the guide member 42 which is fitted around the crank member 28.

The half-rotation clutch mechanism 46 restricts the range of relative rotation between the first shaft portion 44 and the second shaft portion 46 to substantially a half rotation, and comprises a cylindrical member 47 which is coaxially non-rotatably fixed to an end portion of the second shaft portion 45, and a stopper pin 48 radially outwardly projecting from an end portion of the first shaft portion 44 which is coaxially and rotatably inserted in the cylindrical member 47.

The cylindrical member 47 is formed in a cylindrical shape having an insertion hole 49 penetrating in the axial direction through a center portion of the cylindrical member 47, and has a bearing 50 for rotatably supporting the end portion of the first shaft portion 44 at the open edge portion on the reduction gear 34 side. A semicircular lateral groove 51 having the length corresponding to the half rotation in the peripheral direction is formed at an intermediate position in the axial direction of the cylindrical member 47, and the lateral groove 51 has a depth extending from the outer peripheral surface of the cylindrical member 47 to the insertion hole 49.

The stopper pin 48 fixed by threading a set screw or the like so as to radially outwardly project is disposed on the end portion of the first shaft portion 44 and the projecting end portion of the pin 48 is movably received in the lateral groove 51 of the cylindrical member 47.

With this construction, the first shaft portion 44 provided with one of the right and left crank members 28 is relatively rotatable within the substantially half-rotation range with respect to the cylindrical member 47 constituting the half-rotation clutch mechanism 46, while the second shaft portion 45 provided with the other crank member 28 of the right and left crank members 28 is fixed so as to be non-rotatable with respect to the cylindrical member 47.

Accordingly, when the first shaft portion 44 of the second rotary shaft 27 is forwardly rotated by the second operating mechanism 8, the stopper pin 48 abuts against one end face in the peripheral direction of the semicircular lateral groove 51 of the cylindrical member 47, and this abutting causes the second shaft portion 45 to be rotated integrally with the first shaft portion 44 in the forward rotational direction.

On the other hand, when the first shaft portion 44 is reversely rotated from the above state, the stopper pin 48 is moved in the lateral groove 51, and abuts against the other end face in the peripheral direction. This abutting causes the second shaft portion 45 to be reversely rotated integrally with the first shaft portion 44.

The lateral groove 51 is formed in the cylindrical member 47 so that the position of the shaft portion 28A of the crank member 28 provided on the first shaft portion 44 and the shaft portion 28A of the crank member 28 provided on the second shaft portion 45 are displaced to each other by 180 degrees about the axis of the second rotary shaft 27 when the second rotary shaft 27 is rotated in any one of forward and reverse directions, while the positions of the shaft portions 28A of the crank members 28 are arranged to be in phase with each other (coaxial to each other) when the second rotary shaft 27 is rotated in the other direction.

Figure 9A:
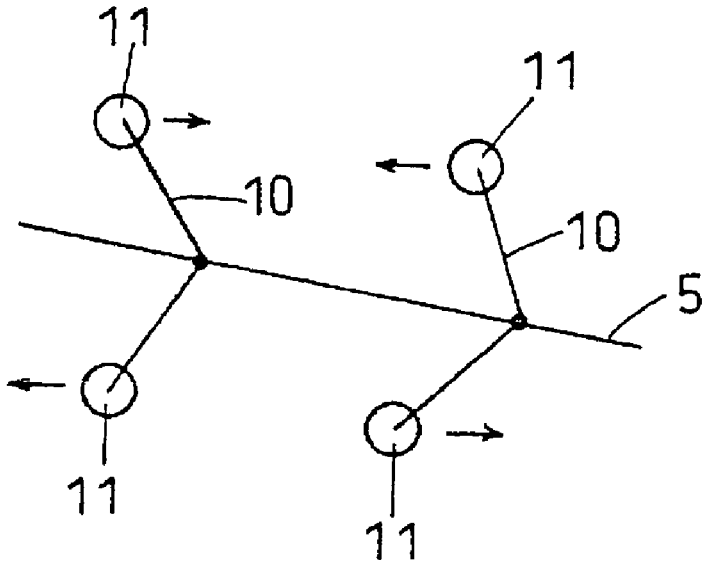
FIGS. 9A and 9B are operation diagrams showing a tapping massage motion.
Figure 9B:
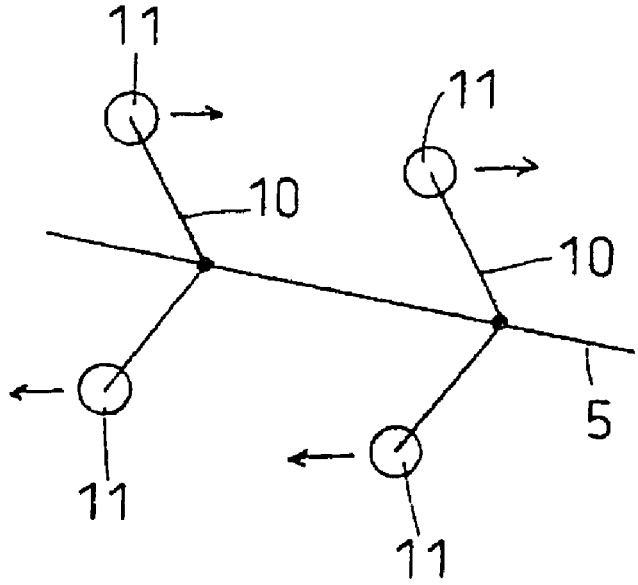

Therefore, in the tapping operation, a mode in which each pair of the massaging heads 11 corresponding in the right-and-left direction are alternately protruded or retracted as shown in FIG. 9A and a mode in which each pair of the massaging heads 11 corresponding in the right-and-left direction are simultaneously protruded or retracted in the right-and-left direction as shown in FIG. 9B can be switched by forward/reverse rotation of the second rotary shaft 27, and thus a variety of massaging operations can be obtained.

In a state where the shaft portions 28A of the right and left crank members 28 are displaced by 180 degrees, projecting amounts of the massaging heads 11 corresponding in the right-and-left direction toward the user's body are different from each other. Therefore, for performing kneading operation, the second rotary shaft 27 is forwardly or reversely rotated in advance so that the positions of the shaft portions 28A of the right and left crank members 28 are arranged to be in phase, whereby the projection amounts to the user's body of the massaging heads 11 corresponding in the right-and-left direction are unified.

That is, the control circuit of the massaging mechanism is configured to actuate not only the first operating mechanism 7, but also the second operating mechanism 8 to rotate the second rotary shaft 27 by at least a half-rotation just before or substantially at the same time as the actuation of the first operating mechanism 7, thereby arrangeing the shaft portions 28A of the right and left crank members 28 to be in phase, so that proper kneading massage can be performed at all times.

In the half-rotation clutch mechanism 46 described above, in order to moderate the shock caused by the rapid switching operation of the mechanism 46, a brake cylinder 52 covering the outer periphery of the cylindrical member 47 is fixed to the end portion of the first shaft portion 44, and a rubber pad 53 for increasing sliding friction to the outer peripheral surface of the cylindrical member 47 is fixed to the inner peripheral surface of the brake cylinder 52. However, such braking means may be arbitrarily used.

Figure 11:
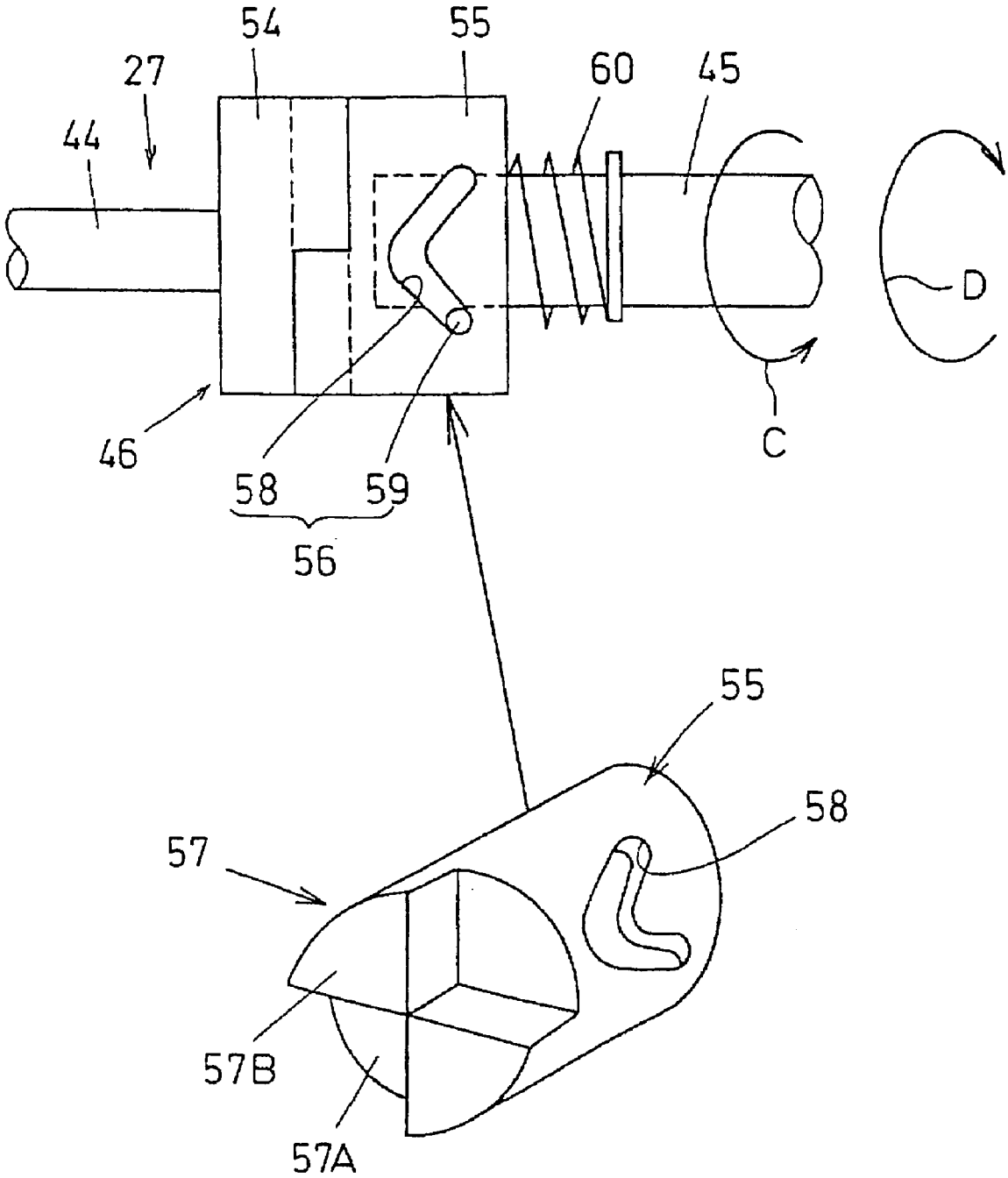
FIG. 11 is a front view showing another embodiment of the half-rotation clutch mechanism.
Figure 12:
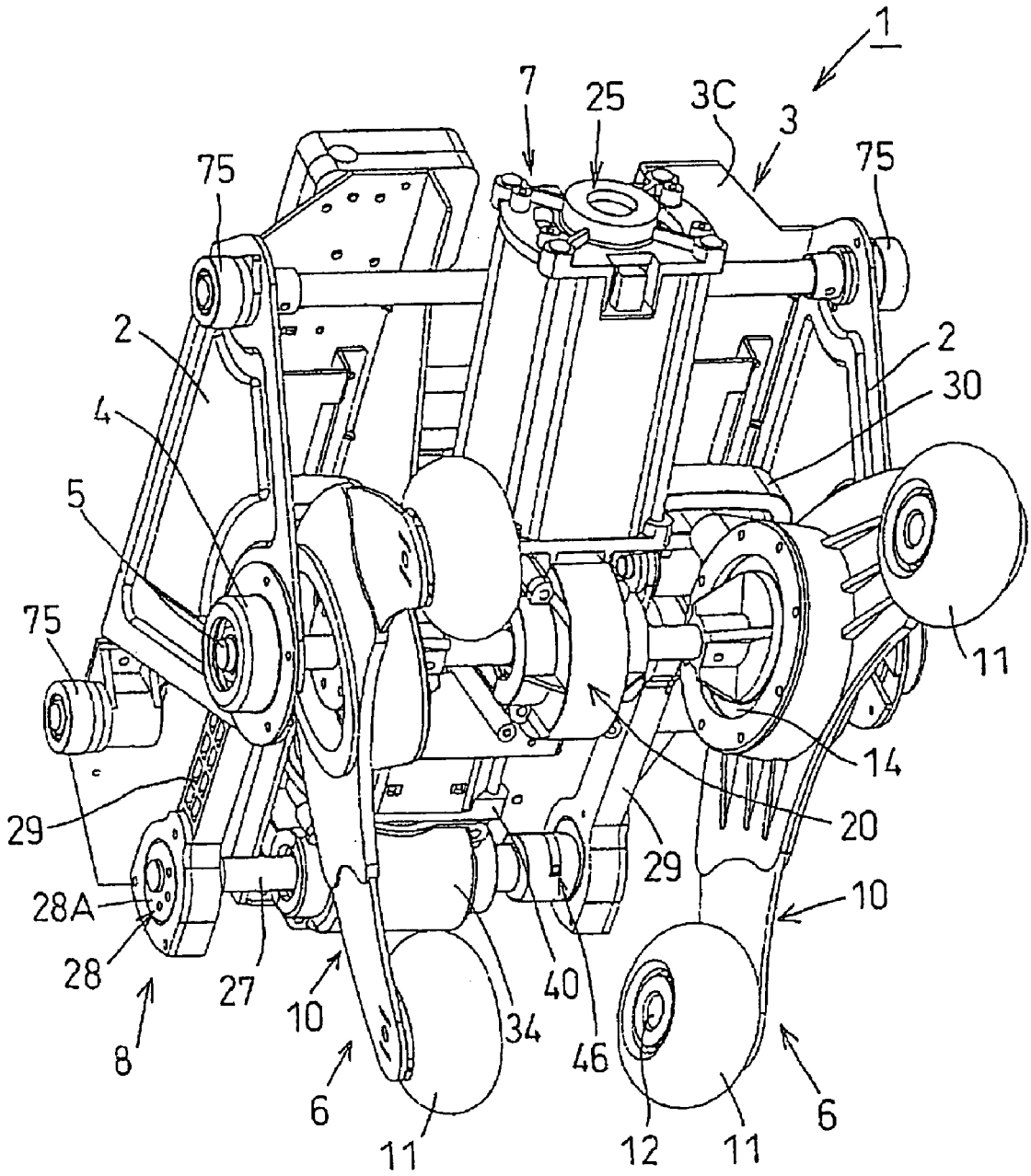
FIG. 12 is a perspective view showing a four massaging head type massaging mechanism according to a second embodiment of the invention which is obliquely viewed from the upper side.

FIG. 11 shows another embodiment of the half-rotation clutch mechanism 46 shown in FIG. 10.

In this case, the half-rotation clutch mechanism 46 has a first clutch member 54 fixed to the end portion of the first shaft portion 44, a second clutch member 55 into which the end portion of the second shaft portion 45 is inserted so as to be rotatable within the half-rotation range and movable in the axial direction with respect to the second shaft portion 45 and which is detachably engaged with the first clutch member 54, and cam means 56 which temporarily disengages the second clutch member 55 from the first clutch member 54 at an initial stage that the second rotary shaft 27 is forwardly or reversely rotated and then engages the second clutch member 55 with the first clutch member 54 again.

The first and second clutch members 54, 55 are each formed with a clutch gear 57 including a recess portion 57A and a projecting portion 57B which are each formed to have a quarter range in the peripheral direction about the axis of the clutch gear 57 and arranged in turn by 90 degrees. Accordingly, the first clutch member 54 and the second clutch member 55 are engaged with each other at two positions displaced by 180 degrees in the peripheral direction about the axis thereof.

The cam means 56 comprises a boomerang-shaped cam hole 58 defined in an outer peripheral wall of the second clutch member 55, and a cam pin 59 radially projecting from the end portion of the second shaft portion 45, and the projecting end portion of the cam pin 59 is movably engaged with the cam hole 58. The boomerang-shaped cam hole 58 is disposed on the outer peripheral wall of the second clutch member 55 so that a bent portion at the center thereof is located on the first clutch member 54 side and both the end portions thereof are located on the opposite side to the clutch member 54.

The second clutch member 55 is urged to the first clutch member 54 side by a press spring 60 fit around the second shaft portion 45. In the half-rotation clutch mechanism 46 described above, when the rotational direction of the second rotary shaft 27 rotating forwardly in the direction of an arrow C of FIG. 11 is reversed to the direction of an arrow D, the second clutch member 55 is moved in the direction opposing to the first clutch member 54 along the cam hole 58 by repulsive force applied from the cam pin 59, and temporarily disengaged from the first clutch member 54. When the cam pin 59 passes over the bent portion of the cam hole 58, the second clutch member 55 is returned to the first clutch member 54 side, and engaged with the first clutch 54 again.

The same operation as described above is also carried out when the rotational direction of the second rotary shaft 27 reversely rotating in the direction of the arrow D is reversed to the forward direction of the arrow C.

The half-rotation clutch mechanism 46 as described above may be provided on the first rotary shaft 5.

In this case, the first rotary shaft 5 is divided into right and left shaft portions, the cam member 14 is secured to each of the right and left shaft portions, and the half-rotation clutch mechanism 46 is disposed between the right and left shaft portions. In this case, a mode in which the cam faces 14A of the right and left cam members 14 secured to the respective shaft portions are inclined in the opposite directions and a mode in which they are inclined in the same direction can be switched by the forward/reverse rotation of the first rotary shaft 5.

When the cam faces 14A of the right and left cam members 14 are inclined in the same direction, the two corresponding massaging heads 11 in the right-and-left direction move in the same right/left direction, thereby allowing a massage operation in which the user's body is locally rubbed in the right-and-left direction, which is different from the kneading massage in which the user's body is pinched as described above.

The first driving member 25 and the second driving member 40 may be controlled by the control circuit so that when one of them is actuated, the actuation of the other driving member is restrained or so that both the driving members are simultaneously actuated. In the latter case, by reciprocatingly rotating the swing arm 10 about the first rotary shaft 5 while swinging it in the right-and-left direction, the tapping massage can be carried out while the massaging heads 11 are moved in the right-and-left direction.

Furthermore, the first driving member 25 may be configured to perform functions of both the first and the second driving members 25, 40. In this case, the second operating mechanism 8 is constructed by the constituent elements other than the second driving member 40, i.e., the second rotary shaft 27,the reduction gear 34,the crank member 28, the interlocking member 29, etc., and the second operating mechanism 8 thus constructed is movably supported by the guide support portion 41.

FIGS. 12 to 18 show a second embodiment of the four massaging head type massaging mechanism 1 according to the invention.

This embodiment mainly differs from the first embodiment in constructions of the support frame 3, the guide support portion 41, the crank member 28, the link portion between the interlocking member 29 and the bracing member 30, and the half-rotation clutch mechanism 46.

The same operation and effect as the massaging mechanism 1 described in the first embodiment can be achieved in this embodiment, and the common portions in construction are represented by the same reference numerals, and the detailed description thereof is omitted.

Figure 14:
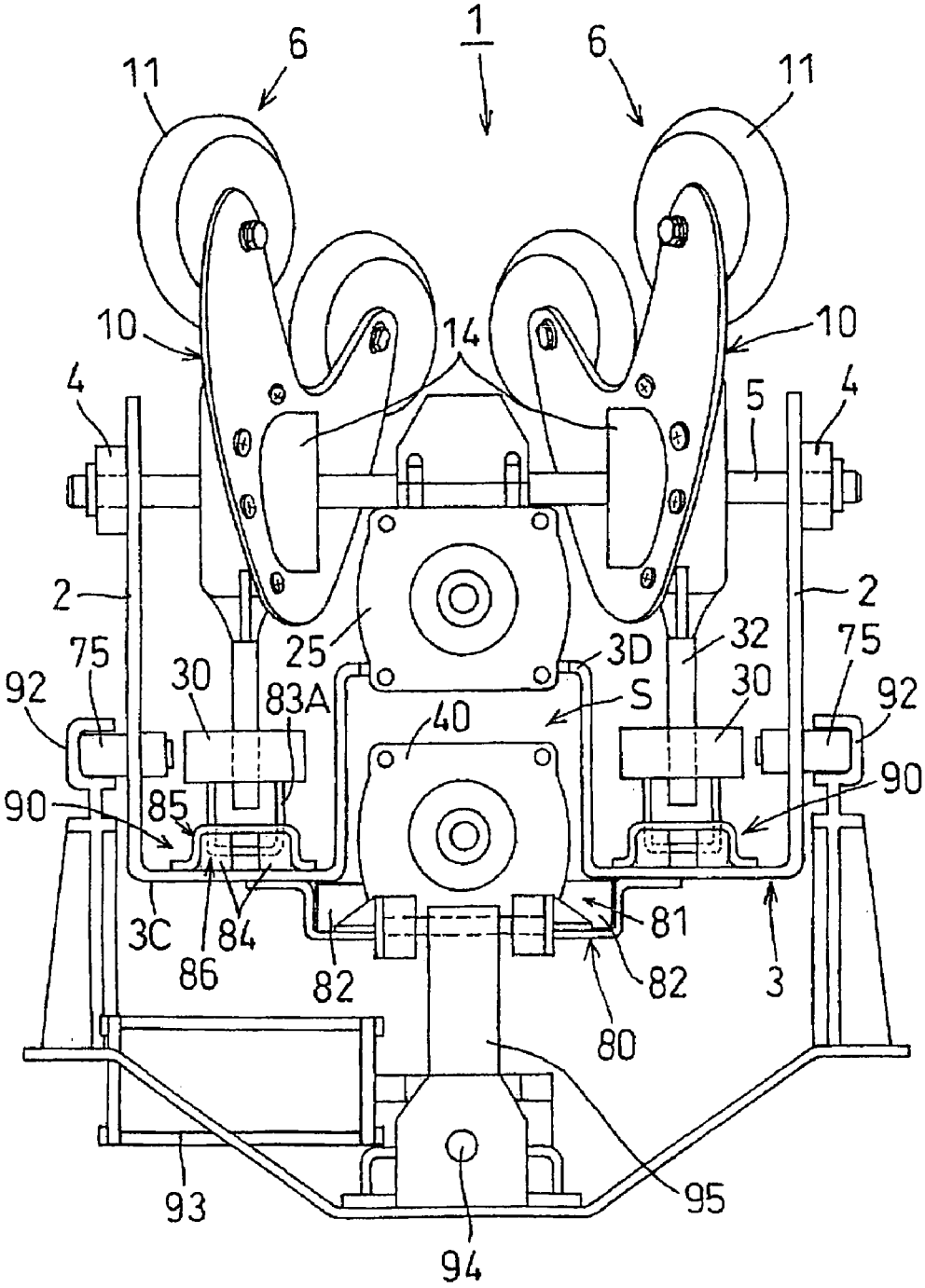
FIG. 14 is a plan view of the massaging mechanism of FIG. 12 which is viewed from the upper side.
Figure 16:
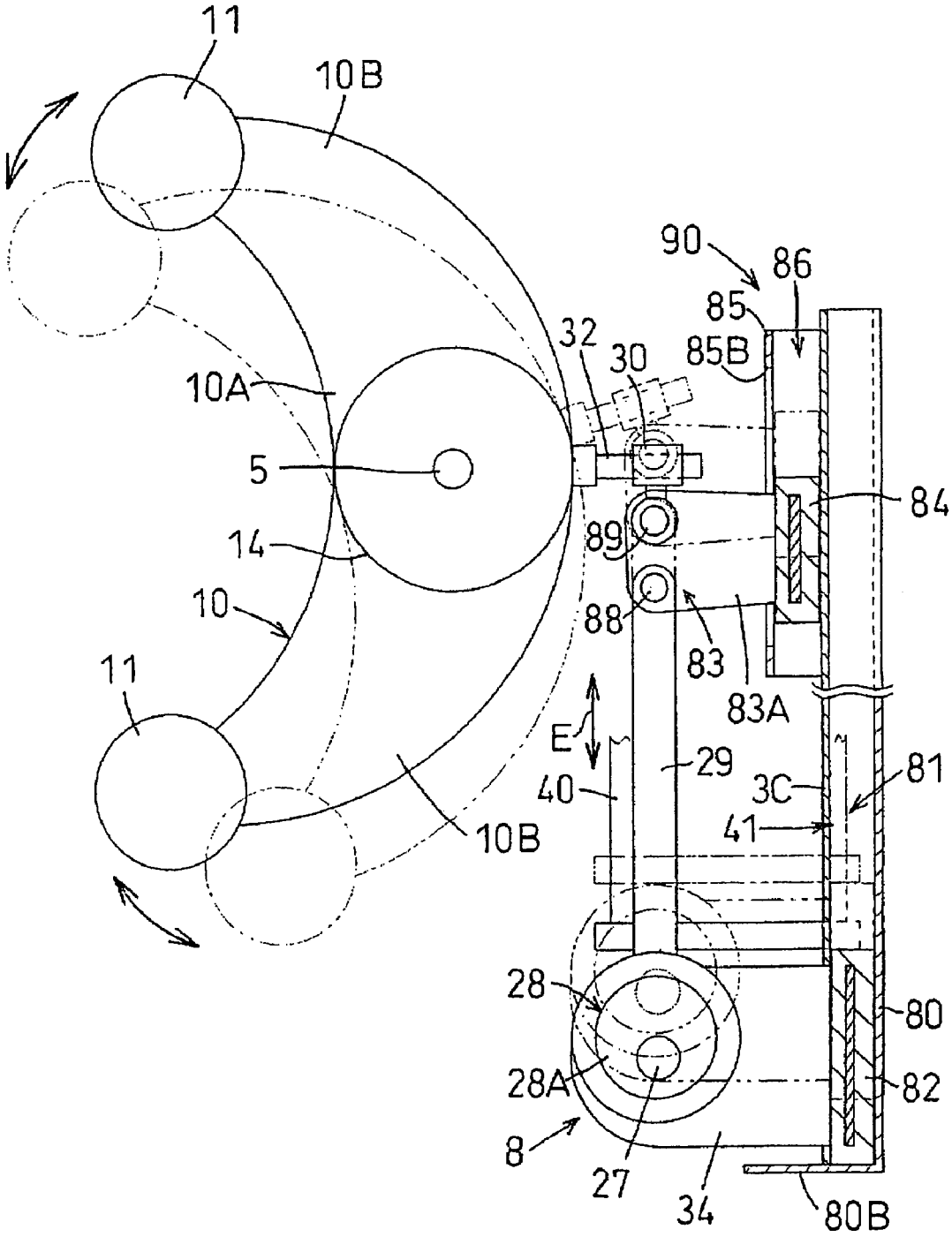
FIG. 16 is a side view of the second operating mechanism.
Figure 18:
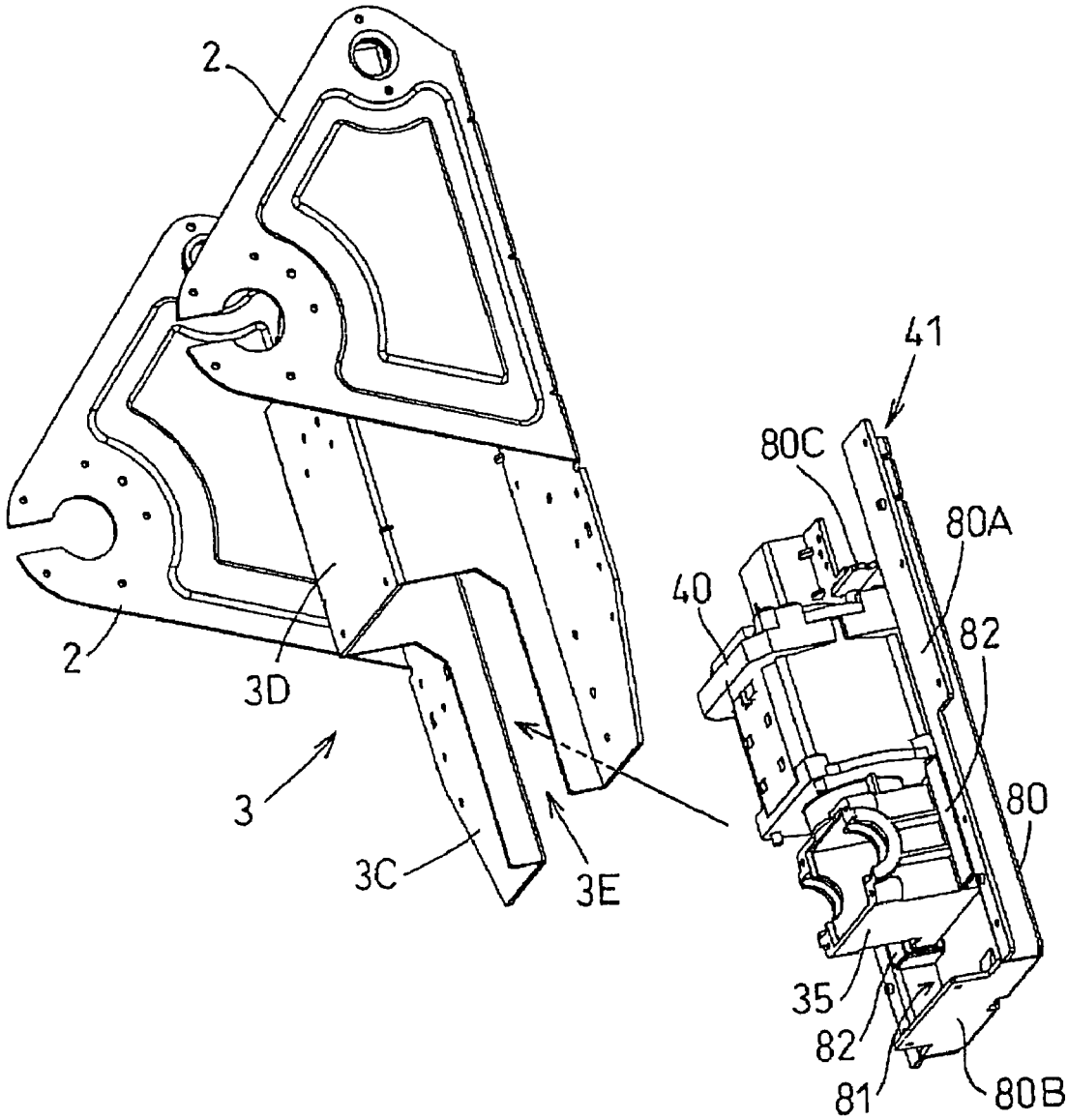
FIG. 18 is an exploded perspective view of a support frame and a guide support portion.

As shown in FIGS. 14, 16 and 18, a support frame 3 of this embodiment has a base plate (back plate) 3C and support brackets 2 forwardly extending from the right and left sides of the base plate 3C, and the base plate 3C and the support brackets 2 are integrally formed by bending a metal plate.

The base plate 3C is bent to form a U-shape in an intermediate portion thereof in the right-and-left direction so as to bulged to the front side, and this bulged portion serves as a mount table 3D to which a reduction gear 20 of a first operating mechanism 7 is fixed.

The base plate 3C has cutout portions in the intermediate portion thereof in the right-and-left direction on upper and lower sides of the mount table 3D, and a second operating mechanism 8 is fixed to the cut-out portion 3E on the lower side.

A guide support portion 41 for movably-supporting the second operating mechanism 8 has a rail member 80 formed by bending a plate material into a U-shape, and a flange portion 80A is formed on each of the right and left sides of the rail member 80. The flange portion 80A is joined to a rear surface of the base plate 3C by a bolt or the like. A guide rail 81 is formed by an inner surface of the rail member 80 and the rear surface of the base plate 3C, and a slider 82 is slidably engaged with the rail 81.

Stoppers 80B, 80C for limiting the movement of the second operating mechanism 8 are integrally formed or separately provided on opposite end portions of the rail member 80, respectively.

The slider 82 is fixed to a gear case 35 of a reduction gear 34, so that the second operating mechanism 8 including the reduction gear 34, as a whole, is slid in the up-and-down direction along the guide rail 81.

A second driving member 40 is disposed in a space S formed on the rear side of the mount table 3D so as to be movable in the space S.

FIG. 16 corresponds to FIG. 6 showing the first embodiment, and shows a state in which the second operating mechanism 8 is moved with being supported by a guide support portion 41 in connection with a rotation of a swing arm 10 about a first rotary shaft 5, and a state in which a bracing member 30 is moved with being supported by a second guide support portion 90 described later.

Figure 13:
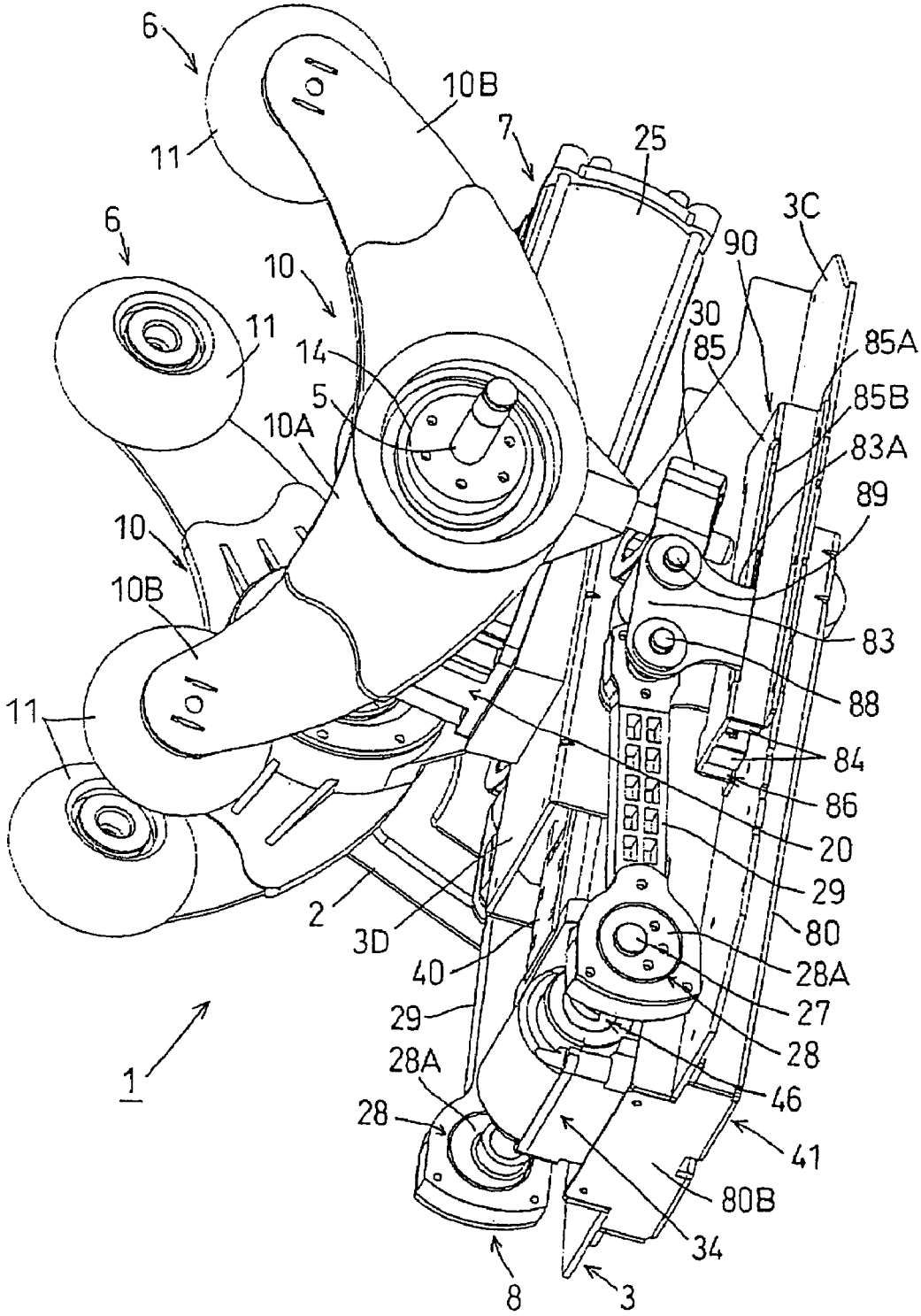
FIG. 13 is a perspective view showing the massaging mechanism of FIG. 12 obliquely viewed from the lower side when one support bracket is omitted.
Figure 15:
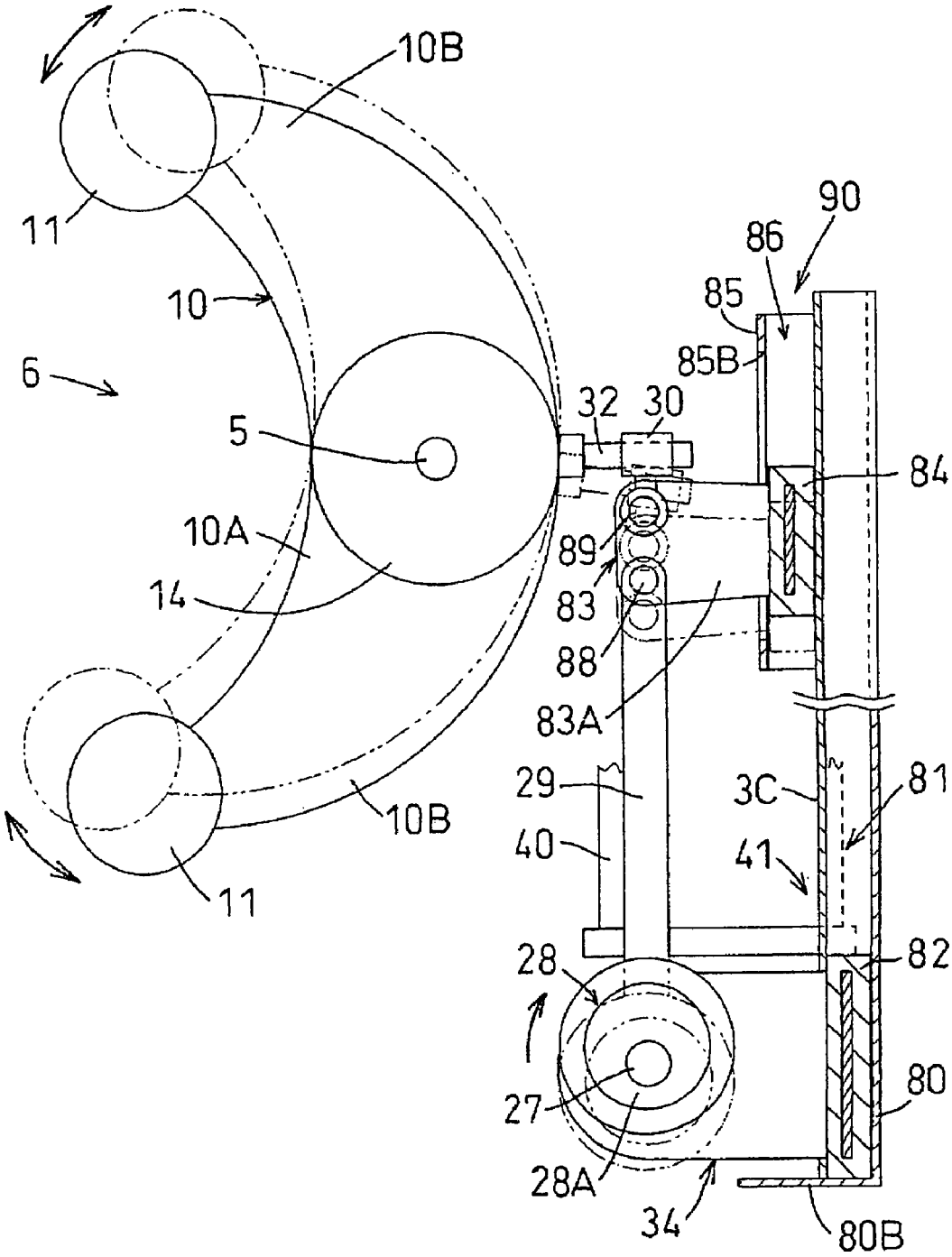
FIG. 15 is a side view of the second operating mechanism.
Figure 17A:
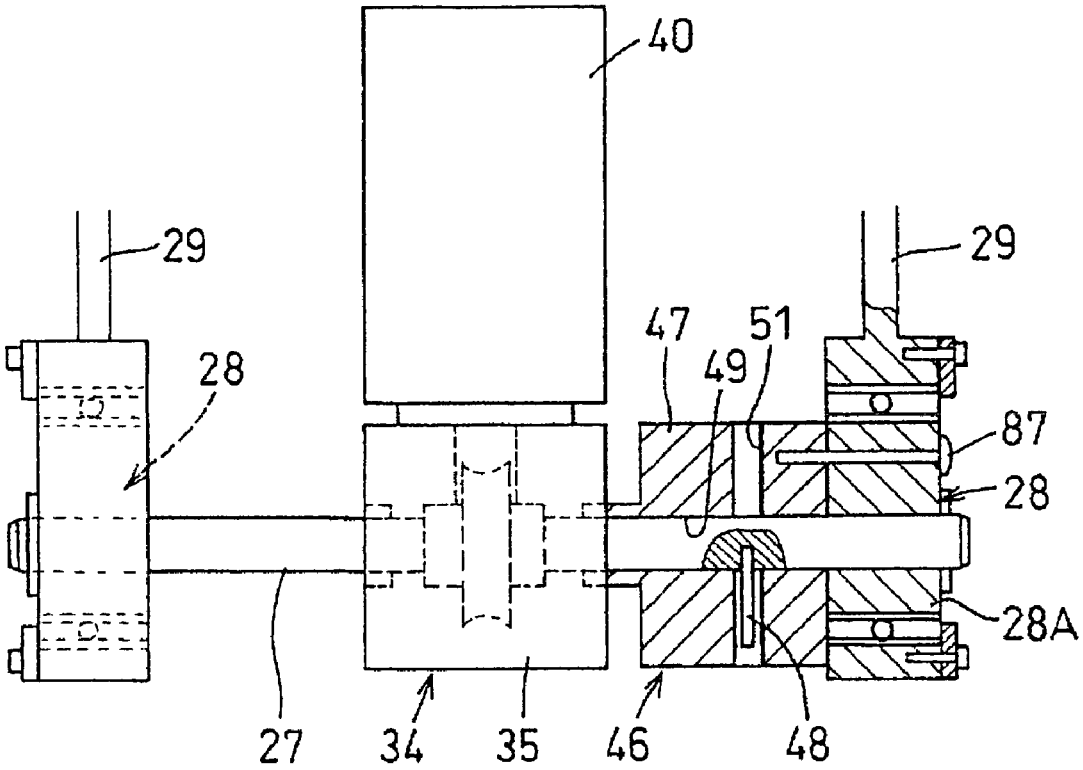
FIG. 17A is a front cross-sectional view of the half-rotation clutch mechanism.
Figure 17B:
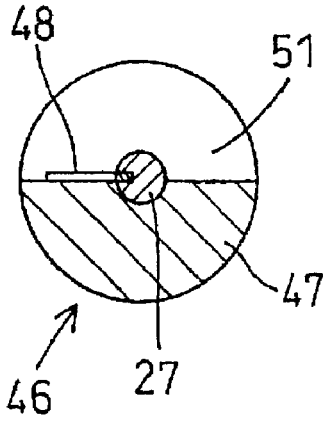
FIG. 17B is a side cross-sectional view of the half-rotation clutch mechanism.

As shown in FIGS. 13, 15 and 17, crank members 28 of this embodiment are provided on opposite end portions of a second rotary shaft 27, respectively, and each crank member 28 has a disc-shaped crank portion 28A having an axis eccentric with respect to an axis of the second rotary shaft 27. One end portion of an interlocking member 29 is rotatably linked to the outer periphery of the crank portion 28A through a bearing.

The crank portion 28A of this embodiment has a function as a shaft in that the interlocking member 29 is pivotally joined to the crank portion 28A, and it constitutes the shaft portion 28A as in the case of the first embodiment.

The other end portion of the interlocking member 29 is pivotally joined to a joint link 83 through a joint pin 88, and the bracing member 30 is also pivotally joined to the joint link 83 through a joint pin 89. Accordingly, the interlocking member 29 and the bracing member 30 are not directly connected to each other as in the case of the first embodiment, but connected to each other through the joint link 83.

The joint link 83 serves as a constituent element of a second guide support portion 90 for movably supporting the bracing member 30.

The second guide support portion 90 has the joint link 83, a slider 84 secured through a leg portion 83A rearwardly extending from the joint link 83, and a guide rail 86 with which the slider 84 is slidably engaged.

Rail members 85 are provided on the right and left sides of the mount table 3D on the front side of the base plate 3C of the support frame 3. The rail member 85 is formed by bending a plate member in a U-shape, and fixed to the base plate 3C by fixing flange portions 85A formed on the right and left sides thereof to the base plate 3C with bolts. The box-shaped guide rail 86 is formed by an inner surface of the rail member 85 and the front surface of the base plate 3C, and the slider 84 is slidably engaged with the rail 86.

Longitudinally extending openings 85B are defined in a bottom surface of each of the U-shaped rail members 85 on right and left end portions thereof, and each of the leg portions 83A is inserted through the opening 85B.

As described above, the bracing member 30 is slidably supported by the second guide support portion 90, thereby smoothly moving the bracing member 30 during tapping massage or the like, and preventing the bracing member 30 from being twisted with an engagement member 32 of the swing arm 10 or falling off from the engagement member 32.

FIG. 15 corresponds to FIG. 5 showing the first embodiment, and shows a state in which the bracing member 30 is moved with being supported by the second guide support portion 90 during tapping massage.

The second rotary shaft 27 is provided with a half-rotation clutch mechanism 46 as in the first embodiment, however, the detailed construction of the half-rotation clutch mechanism 46 is slightly different from that of the first embodiment.

In the first embodiment, the second rotary shaft 27 is divided into the first shaft portion 44 and the second shaft portion 45, and the half-rotation clutch mechanism 46 is disposed between the shaft portions 44, 45. According to this embodiment, the second rotary shaft 27 is not divided, but it is constructed by a single shaft. In this point, the structure is simplified.

As shown in FIG. 17, the half-rotation clutch mechanism 46 has a cylindrical member 47 having an insertion hole 49 penetrating in the axial direction, and the second rotary shaft 27 is relatively rotatably inserted in the insertion hole 49 of the cylindrical member 47.

One of a pair of right and left crank members 28 disposed to be adjacent to the cylindrical member 47 is relatively rotatably mounted on the second rotary shaft 27, and joined to the cylindrical member 47 through a joint piece 87 such as a pin, screw or the like so as to be rotatable integrally with the cylindrical member 47.

A semicircular lateral groove 51 having a length corresponding to a half-turn in the peripheral direction and a depth extending from the outer peripheral surface of the cylindrical member 47 to the insertion hole 49 is formed on an intermediate position of the cylindrical member 47 in the axial direction, and a stopper pin 48 projected from the second rotary shaft 27 is movably received in the lateral groove 51.

The other crank member 28 of the right and left crank members 28 is fixed to the end portion of the second rotary shaft 27 so as to be rotatable integrally with the second rotary shaft 27.

Accordingly, one of the right and left crank members 28 and the other crank member 28 are relatively rotatable within a substantially half-turn range. When the second rotary shaft 27 is forwardly rotated by the second operating mechanism 8, the latter crank member 28 is immediately rotated in the forward direction, and the former crank member 28 is rotated in the forward rotational direction together with the second rotary shaft 27 after the stopper pin 48 abuts against one end face in the peripheral direction of the lateral groove 51 (an end face in the forward direction).

On the other hand, when the second rotary shaft 27 is reversely rotated from the above state, the latter crank member 28 is immediately rotated in the reverse direction, and the former crank member 28 is rotated together with the second rotary shaft 27 after the stopper pin 48 is moved in the lateral groove 51 by a half turn and then abuts against the other end face in the peripheral direction (an end face in the reverse direction).

As in the case of the first embodiment, the lateral groove 51 is formed in the cylindrical member 47 so that the axes of the crank portion 28A of one of the right and left crank members 28 and the crank portion 28A of the other crank member 28 are displaced by 180 degrees when the second rotary shaft 27 is rotated in any one of the forward and reverse directions while the axes of both of the crank portions 28A are arranged to be in phase (coaxial to each other) when the second rotary shaft 27 is rotated in the other direction.

Accordingly, as in the case of the first embodiment, both or any one of the operations shown in FIGS. 9A and 9B can be performed as the tapping massage. When the kneading massage is carried out by the first control mechanism 7, the second operating mechanism 8 is controlled so that the projection amounts to the user's body the two corresponding massaging heads 11 in the right-and-left direction are unified, whereby the massage operation can be performed.

Figure 19:
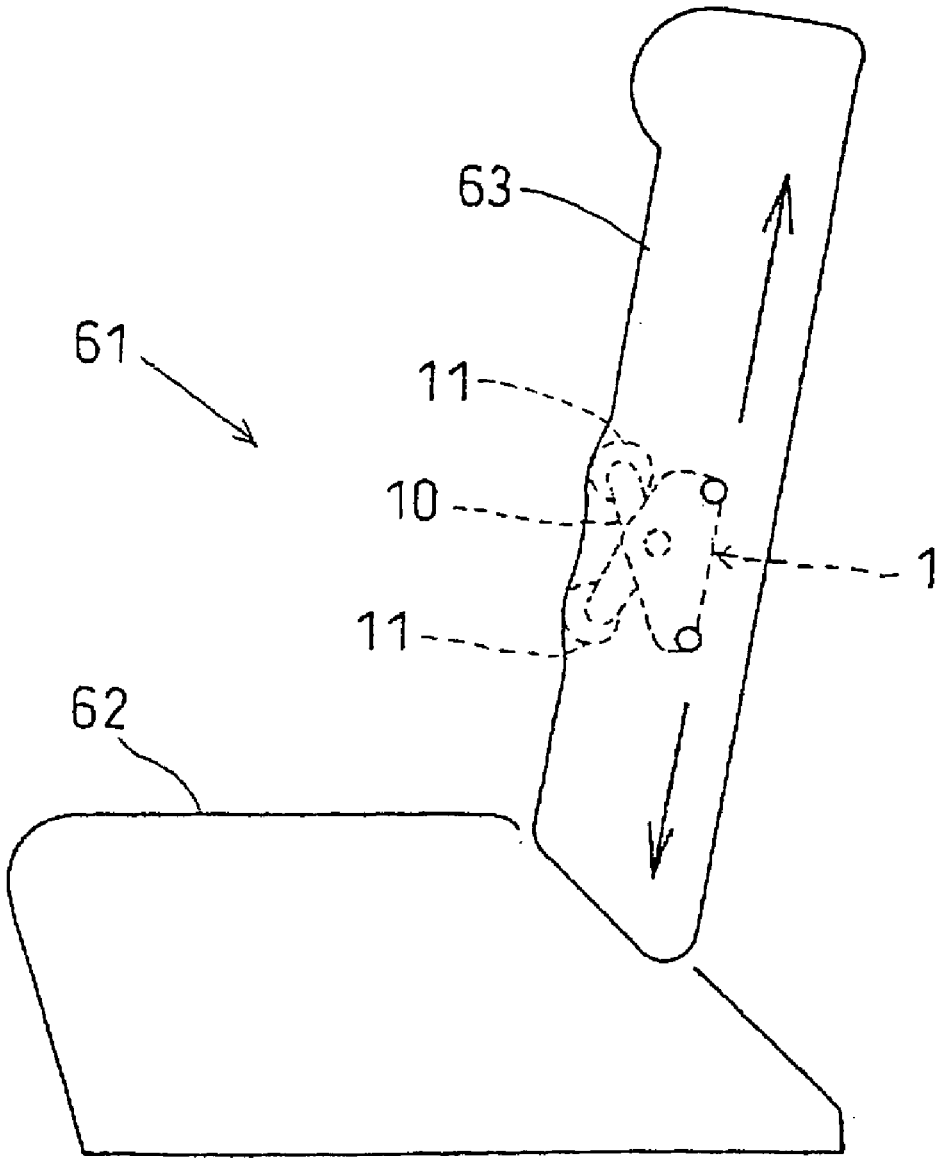
FIG. 19 is a side view showing a chair massaging apparatus incorporating the four massaging head type massaging mechanism according to the invention.

FIG. 19 shows a first embodiment of massaging apparatus incorporating the four massaging head type massaging mechanism 1 according to the invention.

Massaging apparatus 61 according to this embodiment is of a chair type having a seat portion 62, a backrest portion 63 upwardly extending from a rear end of the seat portion 62, and the massaging mechanism 1 disposed within the backrest portion 63.

As shown in FIGS. 1, 2, 12 and 14, the massaging mechanism 1 has guide rollers 75 which are rotatably provided on the upper and lower end portions of the respective support brackets 2,2 or to the respective support brackets 2 and the base plate 3C. When the massaging mechanism 1 is incorporated in the backrest portion 63, it is preferable to provide moving means for moving the massaging mechanism 1 in the up-and-down direction (a guide rail for guiding the guide roller 75, an elevating mechanism or the like). With this construction, the massage can be carried out on a broad range from the back of the head to the waist.

FIG. 14 shows an example of the moving means. In this moving means, guide rollers 75 are rotatably engaged with a pair of right and left guide rails 92 extending in the up-and-down direction, and a screw shaft 94 which is rotated about an axis thereof by an elevating motor 93 is disposed along the up-and-down direction, and an engagement member 95 engaged with the massaging mechanism 1 is threadingly engaged with the outer periphery of the screw shaft 94. In this case, when the screw shaft 94 is rotated by driving the elevating motor 93, the engagement member 95 is upwardly or downwardly screw-fed, thereby causing the massaging mechanism 1 to upwardly/downwardly move along the guide rails 92.

The seat portion 62 may be designed to be directly placed on the floor (legless chair type), or designed to have legs of a predetermined height from the floor.

Figure 20:
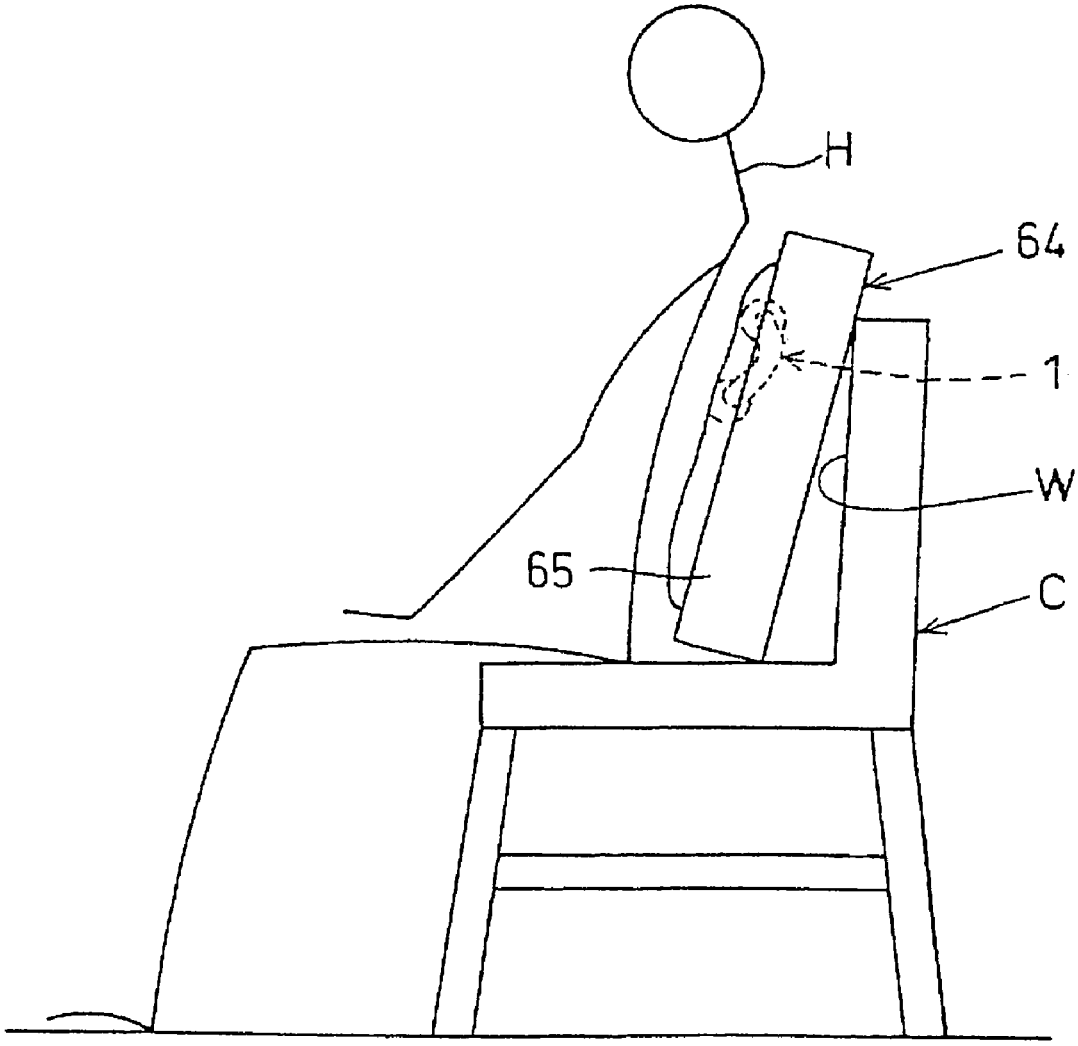
FIG. 20 is a side view showing an example of use of a leaner massaging apparatus incorporating the four massaging head type massaging mechanism according to the invention.
Figure 21:
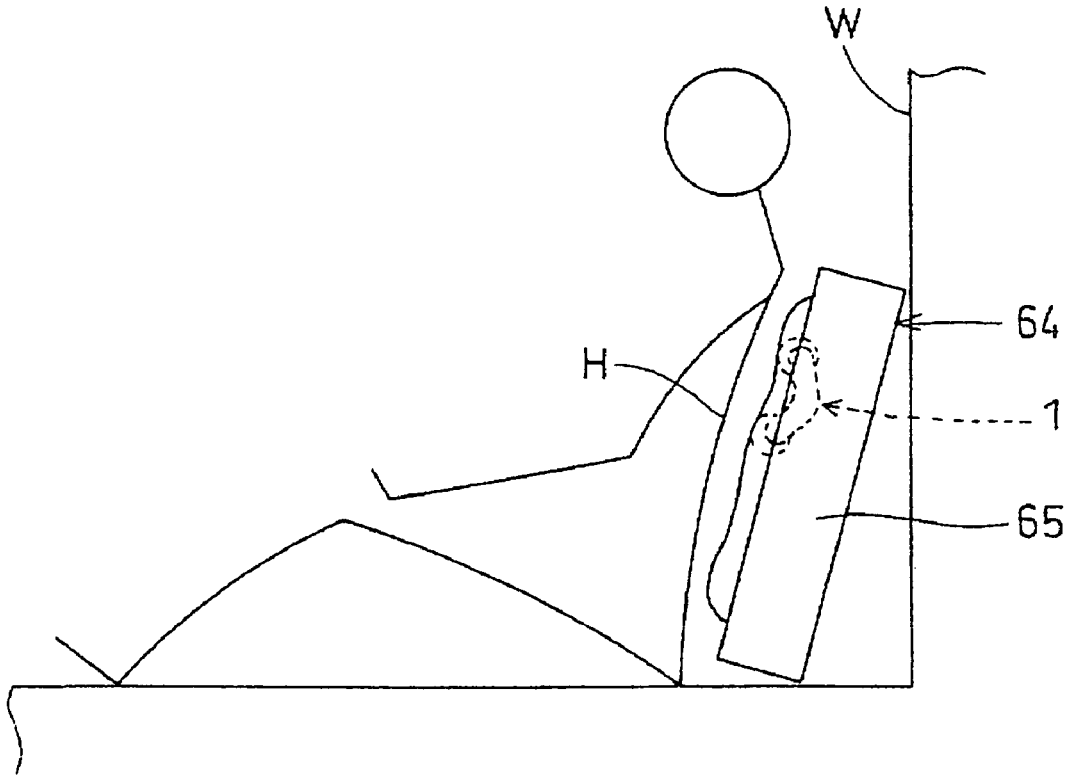
FIG. 21 is a side view showing another example of use of the leaner massaging apparatus incorporating the four massaging head type massaging mechanism according to the invention.

FIGS. 20 and 21 show a second embodiment of massaging apparatus housing the four massaging head type massaging mechanism 1 according to the invention.

Massaging apparatus 64 according to this embodiment is of a leaner type having an independent one-piece casing 65 which has a longitudinal dimension substantially corresponding to a back area of a user's body and can be leaned against a wall face W with a rear surface thereof facing the wall face W. The massaging mechanism 1 is housed in the casing 65 so as to be upwardly/downwardly movable.

In this case, the casing 65 is formed in a longitudinally elongated flat box shape defining an longitudinally extending opening on a front surface thereof, and it can be leaned against a wall face W of a room as shown in FIG. 21 or a wall face W of a backrest portion of a chair C as shown in FIG. 20. The massaging mechanism 1 is housed in the casing 65 so that the respective massaging heads 11 are oriented toward the opened front surface of the casing 65.

Since the casing 65 is designed in such an elongated flat box shape so that it can be leaned against the wall face as described above, the user's back can be massaged over a broad range as in the case of the chair type massaging apparatus 61 as described above by using the massaging apparatus 64 by leaning the casing 65 against the wall face W as shown in FIGS. 20 and 21.

On the other hand, since the casing 65 is designed in an elongated flat box shape unlike the chair type massaging apparatus 61, it can be stored in a corner of the room or in a narrow space between pieces of furniture. Therefore, a compact massaging apparatus having substantially the same function as the chair type massaging apparatus 61 can be achieved at a low cost.

Figure 22:
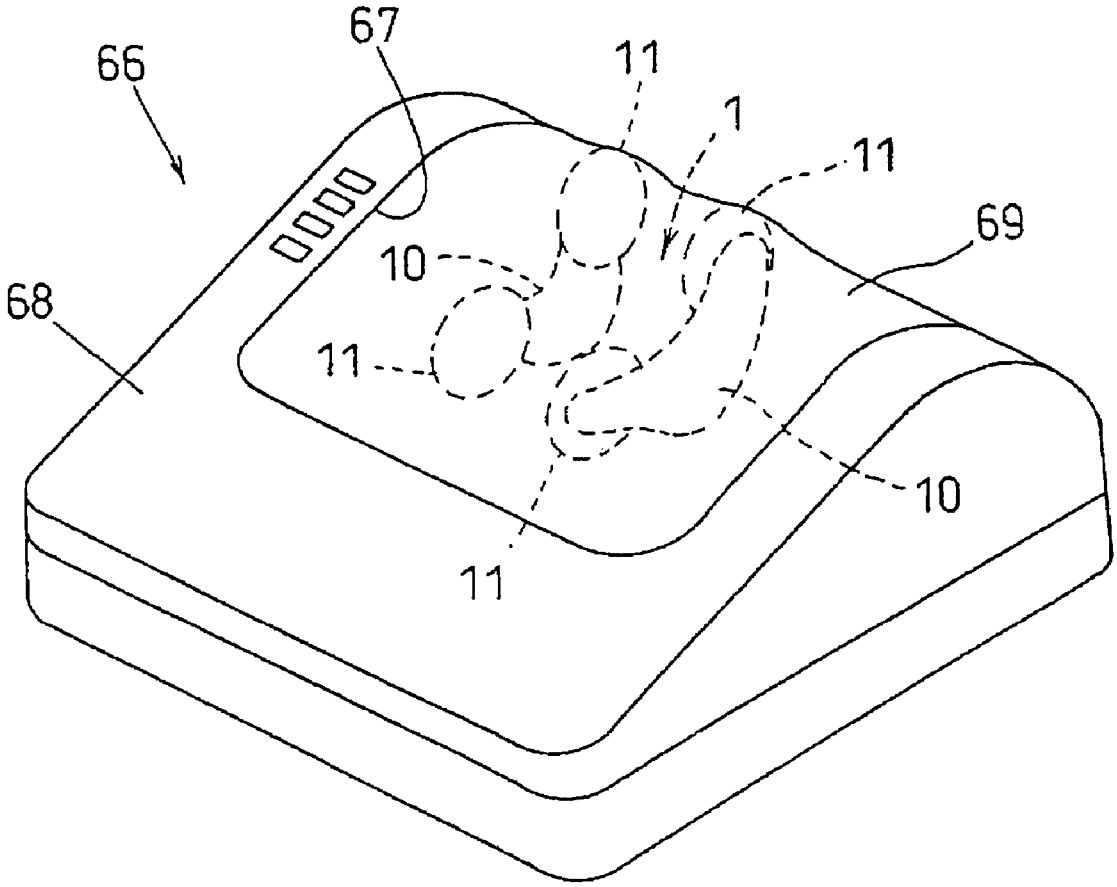
FIG. 22 is a perspective view showing a stationary massaging apparatus incorporating the four massaging head type massaging mechanism according to the invention.

FIG. 22 shows a third embodiment of massaging apparatus housing the four massaging head type massaging mechanism according to the invention.

The massaging apparatus 66 of this embodiment is of a relatively compact flat stationary type and has a stationary type casing 68 defining an opening 67 on upper surface thereof, and the massaging mechanism 1 housed in the casing 68. The opening 67 of the casing 68 is covered by a soft cover member 69 formed of stretch fabric or the like. The massaging apparatus 66 described above can be used by placing it beneath back, waist, thigh or calf of a user's body lying on his/her back, or resting soles of the user on the massaging mechanism while sitting on a chair.

In the stationary massaging apparatus 66 described above, the swing arms 10 and the massaging heads 11 are oriented upward so as to correspond to the opening 67 in the upper surface of the apparatus. Therefore, it should be noted that the arrangement in the up-and-down direction and the arrangement in the front-and-rear direction in the above embodiment are exchanged by each other, that is, the arrangement in the up-and-down direction is set to the arrangement in the front-and-rear direction and the arrangement in the direction penetrating through the sheet face is set to the arrangement in the up-and-down direction.

Figure 23:
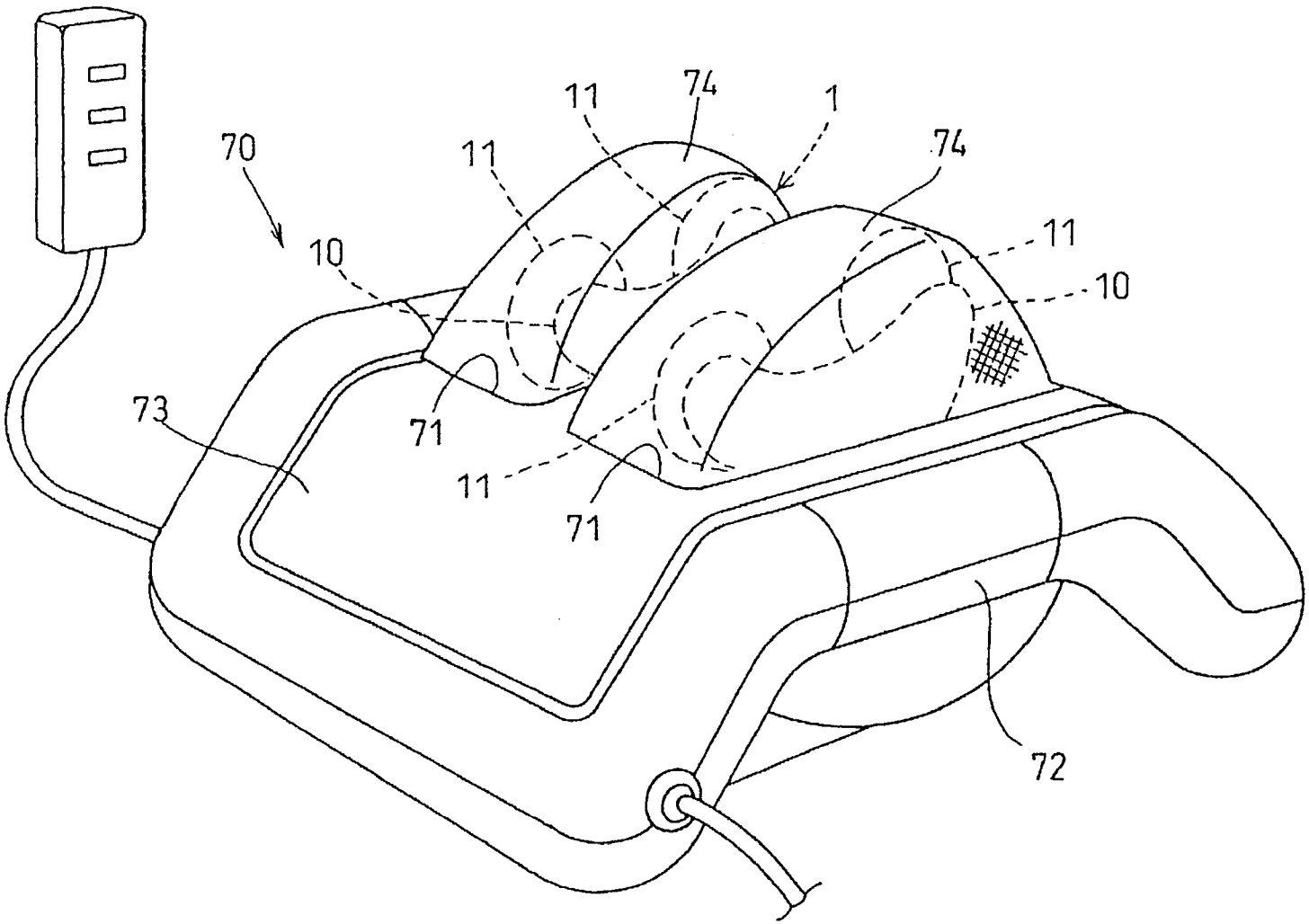
FIG. 23 is a perspective view showing a hand-carriable massaging apparatus incorporating the four massaging head type massaging mechanism according to the invention.

FIG. 23 shows a fourth embodiment of massaging apparatus housing the four massaging head type massaging mechanism according to the invention.

The massaging apparatus 70 of this embodiment has a hand-carriable casing 73 defining openings 71 on a front side thereof (on a top side when the apparatus is placed as shown in FIG. 23) and grip portions 72 on right and left lateral sides thereof, and the massaging mechanism 1 disposed in the casing 73.

The casing 73 has a pair of right and left openings 71,71 through which right and left swing arms 10 are respectively projected upward from the casing 73. The cover member 74 is divided into right and left parts for covering the respective openings 71.

The grip portions 72 are each formed as a cylindrical portion formed integrally with each of the right and left lateral sides of the casing 73, so that a user can massage another person's back by pressing the massaging apparatus 70 against his/her with holding cylindrical portions by both hands. The massaging apparatus 70 of this embodiment may be placed on the floor or the like with the respective massaging heads 11 oriented upward as shown in FIG. 23 so as to be used as a compact stationary type massaging apparatus.

According to the invention described above in detail, since the swing arms are secured to the first rotary shaft, the massaging mechanism can be reduced in thickness and, hence, massaging apparatus of a compact size can be achieved. Furthermore, since the swing arms can be rotated about the first rotary shaft in conformity with the curve of the user's body, effective massage can be performed with the respective massaging heads substantially uniformly contacted to the user's body.

It should be noted that the embodiments described herein are only illustrative of the present invention, but not limitative of the present invention. The scope of the invention is defined by the appended claims, and all modifications and equivalents which can read on the claims are included in the present invention.

What is claimed is:

1. A four massaging head type massaging mechanism comprising:

a first rotary shaft supported in a right-and-left direction;

a pair of right and left swing arms relatively rotatably mounted on the first rotary shaft;

a plurality of massaging heads each secured to an upper end portion and a lower end portion of each of the swing arms;

a bracing member engaged with each of the swing arms so as to restrain the swing arm from rotating in connection with rotation of the first rotary shaft;

a first operating mechanism for swinging the swing arms in opposite directions in the right-and-left direction to each other so that a right and left pair of massaging heads respectively secured to the upper end portions are moved toward each other while a pair of right and left the massaging heads respectively secured to the lower end portions of the swing arms are moved away from each other in the right-and-left direction, and vice versa, by means of the rotation of the first rotary shaft;

a second operating mechanism linked to the bracing member for reciprocatingly rotating the swing arm about an axis of the first rotary shaft through the bracing member; and a first guide support portion for supporting the second operating mechanism so as to be movable following the rotation of the swing arm about the first rotary shaft, wherein the second operating mechanism comprises a second rotary shaft disposed in parallel to the first rotary shaft, a crank member provided on the second rotary shaft and having a shaft portion eccentric with respect to an axis of the second rotary shaft, and an interlocking member having one end portion joined to the shaft portion of the crank member and the other end portion joined to the bracing member, the interlocking member being reciprocated in connection with a rotation of the second rotary shaft, wherein the massaging mechanism further comprises a second guide support portion for movably supporting the bracing member, the second guide support portion having a joint link for rotatably joining the interlocking member with the bracing member, a slider provided on the joint link and a guide rail for slidably supporting the slider.

2. The four massaging head type massaging mechanism as set forth in claim 1, wherein the first operating mechanism has a first driving member for rotary driving the first rotary shaft, while the second operating mechanism has a second driving member for rotary driving the second rotary shaft, the second driving member being disposed on a rear side of the first rotary shaft, while the second rotary shaft and the first driving member being disposed on lower and upper sides of the first rotary shaft, respectively, in a sandwiching manner.

3. The four massaging head type massaging mechanism as set forth in claim 1, wherein the first operating mechanism has a first driving member for rotary driving the first rotary shaft, while the second operating mechanism has a second driving member for rotary driving the second rotary shaft, the first driving member and the second driving member being disposed between the right and left swing arms in the right-and-left direction.

4. The four massaging head type massaging mechanism as set forth in claim 1, wherein the bracing member, the crank member, and the interlocking member are each provided in pair on right and left sides corresponding the pair of right and left swing arms, and the second rotary shaft is provided with a half-rotation clutch mechanism for interlocking one of the right and left crank members with the other crank member so that the right and left crank members are mutually relatively rotatable within a substantially half-turn range.

5. The four massaging head type massaging mechanism as set forth in claim 1, wherein the first operating mechanism comprises the first rotary shaft, a first driving member for rotary driving the first rotary shaft, and a pair of right and left cam members fixed to the first rotary shaft and having cam faces inclined in the opposite directions with respect to the rotary shaft, the cam faces being relatively rotatably engaged with the swing arms, respectively.

6. The massaging head type massaging mechanism as set forth in claim 1, wherein the massaging mechanism is incorporated in a chair massaging apparatus comprising a seat portion and a backrest portion extending upward from an end portion of the seat portion; and the massaging mechanism being housed in the backrest portion with the massaging heads oriented toward a front side of the backrest portion.

* * * * *